US011117789B2

(12) United States Patent
Schoonmaker

(10) Patent No.: US 11,117,789 B2
(45) Date of Patent: Sep. 14, 2021

(54) TELESCOPING BOOM WITH ROTARY EXTENSION AND LOCKING SYSTEM

(71) Applicant: Manitowoc Crane Companies, LLC, Manitowoc, WI (US)

(72) Inventor: Stephen J. Schoonmaker, Chambersburg, PA (US)

(73) Assignee: MANITOWOC CRANE COMPANIES, LLC, Manitowoc, WI (US)

( * ) Notice: Subject to any disclaimer, the term of this patent is extended or adjusted under 35 U.S.C. 154(b) by 0 days.

(21) Appl. No.: 16/429,751

(22) Filed: Jun. 3, 2019

(65) Prior Publication Data

US 2019/0367338 A1 Dec. 5, 2019

Related U.S. Application Data

(60) Provisional application No. 62/680,090, filed on Jun. 4, 2018.

(51) Int. Cl.

| | |
|---|---|
| ***B66C 23/00*** | (2006.01) |
| ***B66C 23/70*** | (2006.01) |
| ***B66C 23/36*** | (2006.01) |

(52) U.S. Cl.

CPC ..... *B66C 23/708* (2013.01); *B66C 23/36* (2013.01); *B66C 23/705* (2013.01); *B66C 2700/0371* (2013.01)

(58) Field of Classification Search

CPC ... B66C 23/703; B66C 23/706; B66C 23/708; B66C 23/42

See application file for complete search history.

(56) References Cited

U.S. PATENT DOCUMENTS 3,269,561 A * 8/1966 De Ligt ..... B65G 1/0407 212/333
3,921,819 A * 11/1975 Spain ..... B66C 23/708 212/349

(Continued)

FOREIGN PATENT DOCUMENTS

KR 20160095702 A 8/2016
WO 2011160583 A1 12/2011

OTHER PUBLICATIONS

Extended European Search Report and Written Opinion dated Nov. 12, 2019 issued in corresponding EP Pat. Appl. 19177876.0-1017.

*Primary Examiner* — Emmanuel M Marcelo

(74) *Attorney, Agent, or Firm* — Klintworth & Rozenblat IP LLP

(57) ABSTRACT

A telescoping boom includes a boom actuator having a fixed part and a movable part, the movable part configured to move along a length the fixed part, a rotary actuator operably connected to the movable part and configured to rotate relative to the movable part, a coupling pin connected to and configured to rotate with the rotary actuator, and a telescoping boom having a plurality of boom sections including a base section and one or more telescoping sections configured for telescoping movement along a longitudinal boom axis relative to the base section. A rotary extension and locking system is mounted on at least one telescoping section and is configured for selective coupling to the boom actuator and selective locking with a nearest outwardly adjacent boom section.

18 Claims, 26 Drawing Sheets

(56) References Cited

U.S. PATENT DOCUMENTS

| | | | | |
|---|---|---|---|---|
| 4,036,372 | A * | 7/1977 | Rao | B66C 23/705 212/230 |
| 4,327,533 | A * | 5/1982 | Sterner | B66C 23/708 212/292 |
| 4,688,689 | A | 8/1987 | Barsuhn | |
| 6,216,895 | B1 * | 4/2001 | Erdmann | B66C 23/708 212/292 |
| 9,090,438 | B2 * | 7/2015 | Krebs | B66C 23/708 |
| 10,457,529 | B2 * | 10/2019 | Schoonmaker | B66C 23/42 |
| 2001/0052506 | A1 * | 12/2001 | Richter | B66C 23/705 212/177 |
| 2002/0056693 | A1 * | 5/2002 | Stowasser | B66C 23/705 212/292 |
| 2003/0057172 | A1 * | 3/2003 | Harrington | B66C 23/708 212/292 |
| 2010/0187194 | A1 | 7/2010 | Schuermann et al. | |
| 2017/0305727 | A1 | 10/2017 | Schoonmaker | |
| 2019/0367338 | A1 * | 12/2019 | Schoonmaker | B66C 23/705 |

* cited by examiner

TELESCOPING BOOM WITH ROTARY EXTENSION AND LOCKING SYSTEM

BACKGROUND

The present disclosure relates generally to a telescoping boom having a rotary extension and locking system.

A known telescoping boom of a crane includes a base section and a plurality of nested telescoping sections configured for movement relative to one another to extend and retract the boom. Movement, i.e., extension and retraction, of the telescoping sections is controlled by a hydraulic actuator having a telescoping rod-cylinder assembly in which a rod is fixed within the base section and a cylinder is telescopically movable relative to the rod. With the cylinder retracted relative to the rod, the rod-cylinder assembly has a minimum length that is substantially the same as a length of the base section. With the cylinder extended relative to the rod, the rod-cylinder assembly has a maximum length that is substantially the same as a combined length of the base section and an extended telescoping section.

A known hydraulic actuator includes a rotating locking mechanism of the type described in the U.S. Pat. Appl. Pub. No. 2017/0305727, commonly assigned with the present application. The rotating locking mechanism includes a motor and a rotating element driven by the motor. The rotating element includes a cylinder-to-section pin configured to rotate into and out of engagement with a telescoping section. With the cylinder-to-section pin engaged with the telescoping section, an axial motion of the hydraulic actuator is transmitted to the telescoping section through the cylinder-to-section pin so that the telescoping section moves with the cylinder of the hydraulic actuator. With the cylinder-to-section pin disengaged from the telescoping section, the cylinder may move axially relative to the telescoping section.

The known hydraulic actuator also includes a boom section connection pin actuator configured to operate a section lock on the telescoping section to lock or unlock the telescoping section to or from an outwardly adjacent telescoping section. The telescoping section is substantially fixed against telescoping movement relative to the outwardly adjacent telescoping section when the section lock is locked and is movable relative to the outwardly adjacent telescoping section when the section lock is unlocked.

Thus, the known hydraulic actuator includes separate actuators, i.e., the motor and the boom section connection pin actuator, to operate the cylinder-to-section pins and the section locks. The telescoping boom may be extended or retracted through coordinated operations of the motor, the boom section connection pin actuator and the cylinder of the rod-cylinder assembly. For example, a telescoping section may be telescopically moved by operating the motor to rotate the cylinder-to-section pins into engagement with a telescoping section, operating the boom section connection pin actuator to unlock the section lock between the telescoping section and an outwardly adjacent telescoping section, extending or retracting the cylinder to move the telescoping section, operating the boom section connection pin actuator to lock the section lock of the telescoping section to the outwardly adjacent telescoping section, operating the motor to disengage the cylinder-to-section pins from the telescoping section, and moving the cylinder relative to the rod and the telescoping section to a position where another telescoping section may be engaged by the cylinder-to-section pin. This process may be repeated to extend or retract additional telescoping sections.

It is desirable to provide a telescoping boom in which a single rotary actuator drives coupling and uncoupling movement of a cylinder-section pin and locking and unlocking movement of a section lock.

SUMMARY

According to one aspect, a telescoping boom includes a boom actuator having a fixed part and a movable part, a rotary actuator operably connected to the movable part and configured to rotate relative to the movable part, a coupling pin connected to and configured to rotate with the rotary actuator, and a telescoping boom having a plurality of boom sections including a base section and one or more telescoping sections configured for telescoping movement along a longitudinal boom axis relative to the base section. A rotary extension and locking system is mounted on each telescoping section and is configured for selective coupling to the boom actuator and selective locking with a nearest outwardly adjacent boom section.

The rotary extension and locking system may include a coupling ring rotatably mounted on the telescoping section, a section pin operably connected to the coupling ring, and a latch configured to selectively engage the section pin. A coupling ring spring may be operably coupled between the telescoping section and the coupling ring to urge the coupling ring to rotate in a predetermined direction. A section pin spring may be operably connected between the telescoping section and the section pin to urge the section pin to move toward a first position, and a latch spring may be operably coupled between the telescoping section and the latch to urge the latch in a direction toward the section pin. The coupling pin may engage the coupling ring in response to rotation of the rotary actuator in a first direction.

The coupling ring may be rotated in the first direction to move the section pin from a first position to a second position in response to further rotation of the rotary actuator and the coupling pin in the first direction. The latch may selectively engage the section pin to hold the section pin in the second position. The latch may be moved into engagement with the section pin under a spring force from the latch spring. The coupling ring may disengage from the section pin in response to further rotation of the coupling ring in the first direction. The coupling ring may further include a lug and the lug may move the latch out of engagement with the section pin in response to further rotation of the coupling ring in the first direction. The section pin may move from the second position to the first position under a spring force of a section pin spring.

The coupling ring may rotate in a second direction to a START position. The section pin may include a spring-loaded arm and the coupling ring may deflect the spring-loaded arm during rotation in the second direction. The coupling ring may rotate in the second direction under a spring force from a coupling ring spring. The coupling pin may disengage the coupling ring in response to rotation of the rotary actuator in the second direction relative to the coupling ring.

The coupling ring may include a coupling slot in which the coupling pin engages the coupling ring. The section pin may include an interlock pin configured to selectively engage the rotary actuator. The rotary actuator may carry out a coupling operation by rotating the coupling pin into engagement with the coupling ring and may carry out a section unlocking operation by rotating the coupling ring to move the section pin to the second position.

According to another aspect, a telescoping boom section includes an elongated section body having an end face and a rotary extension and locking system. The rotary extension and locking system includes a coupling ring rotatably mounted on the end face and configured to receive a coupling pin, a section pin operably connected to the coupling ring, and a latch mounted on the end face and configured to selectively engage the section pin. The coupling ring is configured to rotate relative to the end face in a first direction. The section pin is configured to move relative to the end face from a first position to a second position in response to rotation of the coupling ring in the first direction, and the latch is configured to engage the section pin to hold the section pin in the second position.

The latch may be moved out of engagement with the section pin in response to further rotation of the coupling ring in the first direction.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
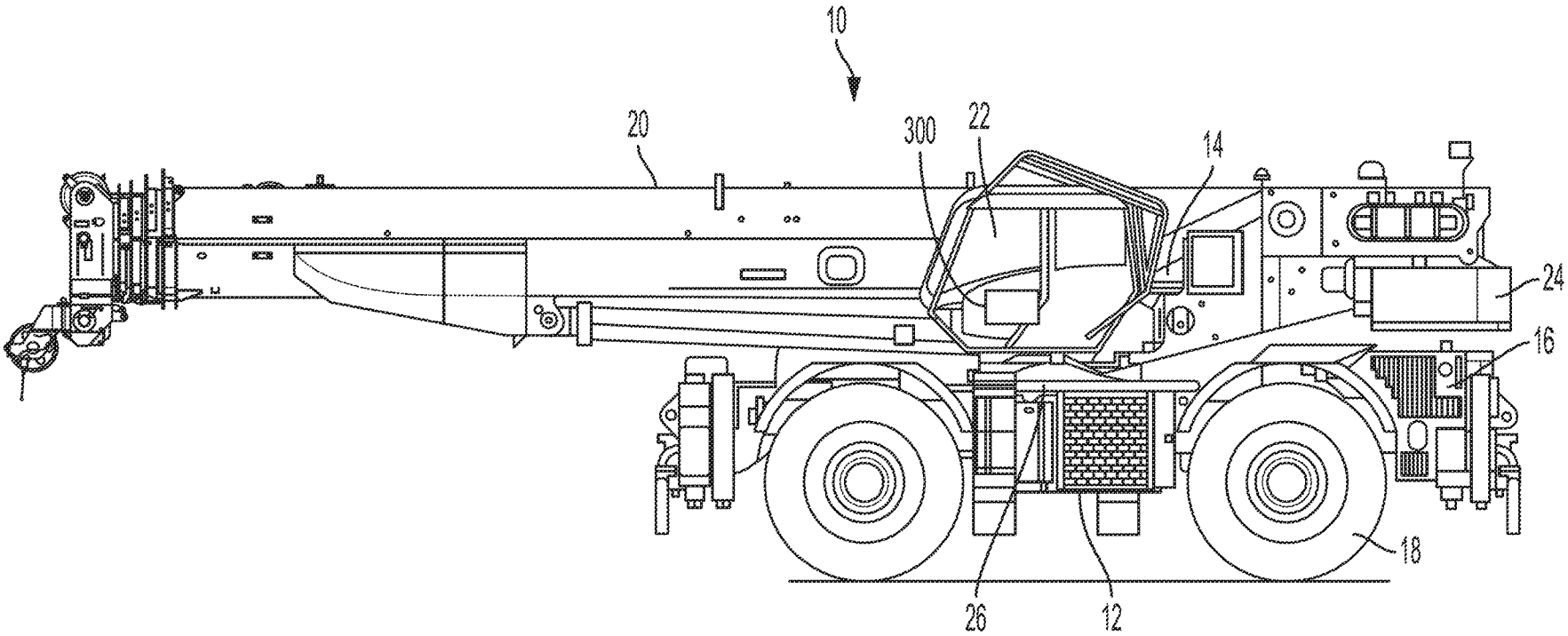
FIG. 1 is a side view of a crane having a telescoping boom according to an embodiment.

FIG. 1 is a side view of a crane 10 according to an embodiment. The crane 10 may be a mobile crane such as a rough-terrain crane, an all-terrain crane, a truck-mounted crane, an industrial crane, a boom truck or other similar construction or utility vehicle. The crane 10 includes a carrier 12 and a superstructure 14. The carrier 12 includes a frame 16 and rolling ground engaging elements 18, such as tires, connected to the frame 16.

The superstructure 14 includes a telescoping boom 20. The superstructure 14 may also include an operator cab 22, a counterweight assembly 24 and other common crane components such as a hoist. The superstructure 14 may be rotatably mounted on the carrier 12, for example, by way of a rotating bed or bearing 26.

Figure 2:
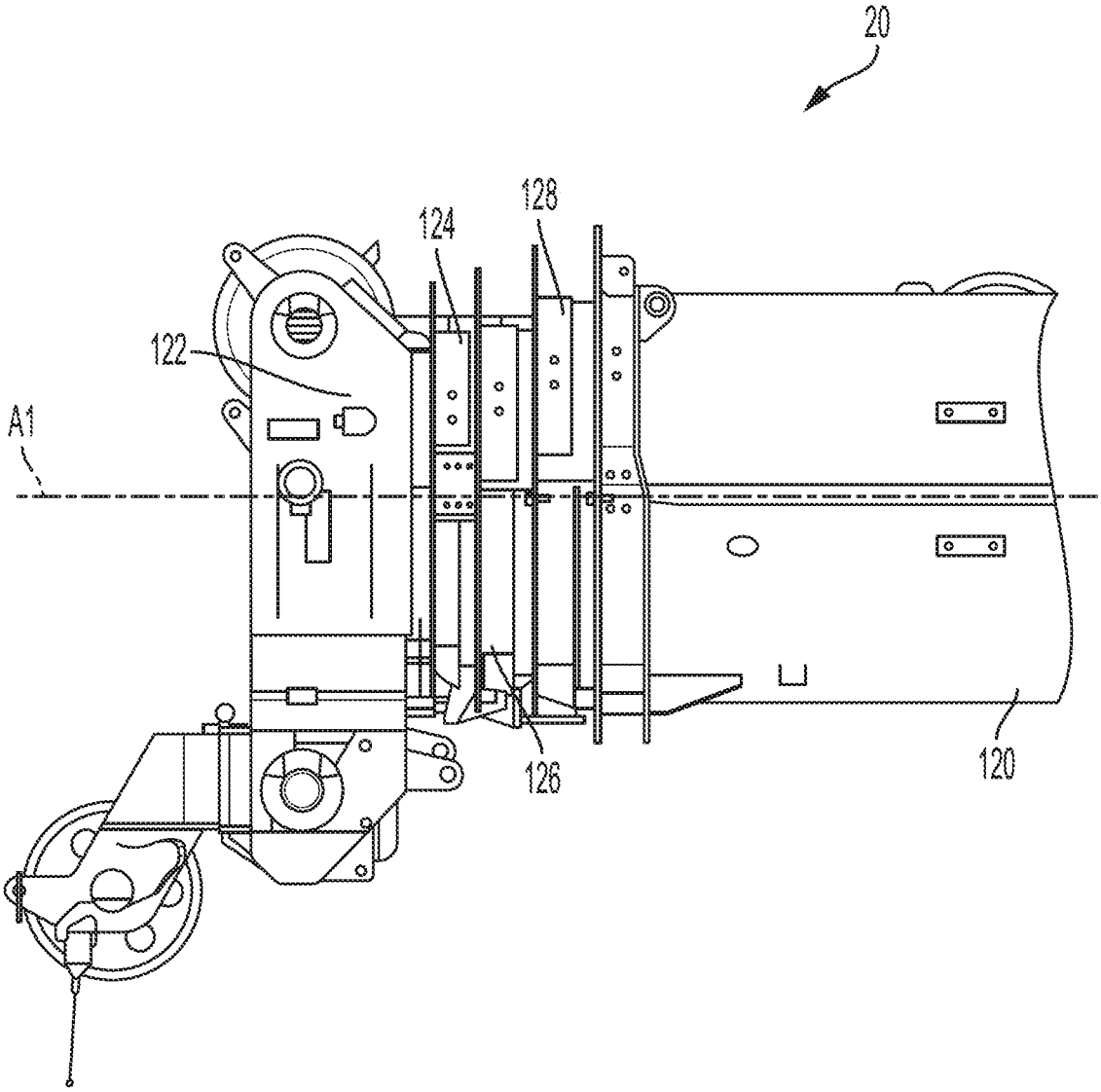
FIG. 2 is an enlarged side view of a distal end of the telescoping boom of FIG. 1.

FIG. 2 is an enlarged side view showing a portion of the telescoping boom 20, according to an embodiment. Referring to FIGS. 1 and 2, the telescoping boom 20 includes a plurality of boom sections 120, 122, 124, 126, 128. The plurality of boom sections 120, 122, 124, 126, 128 includes a base section 120 and one or more telescoping sections 122, 124, 126, 128. Although four telescoping sections are shown, the present disclosure is not limited to such an example. For example, the telescoping boom 20 may have any suitable number of telescoping sections.

Referring to FIG. 2, for ease of reference in the following examples, an innermost telescoping section (i.e., the telescoping section nearest the longitudinal boom axis A1 or most inwardly nested section) is referred to as a first telescoping section 122. A nearest outwardly adjacent telescoping section relative the first telescoping section 122 is referred to as a second telescoping section 124. The next nearest outwardly adjacent telescoping section is referred to as a third telescoping section 126, and the next nearest outwardly adjacent telescoping is referred to as the fourth telescoping section 128. In one embodiment, the base section 120 is the nearest outwardly adjacent boom section relative to the fourth telescoping section 128. The particular numbering of the telescoping sections used herein is not limiting. Each telescoping section 122, 124, 126, 128 is telescopically movable to extend outwardly from and retract into the nearest outwardly adjacent boom section generally along the longitudinal boom axis A1.

Figure 3:
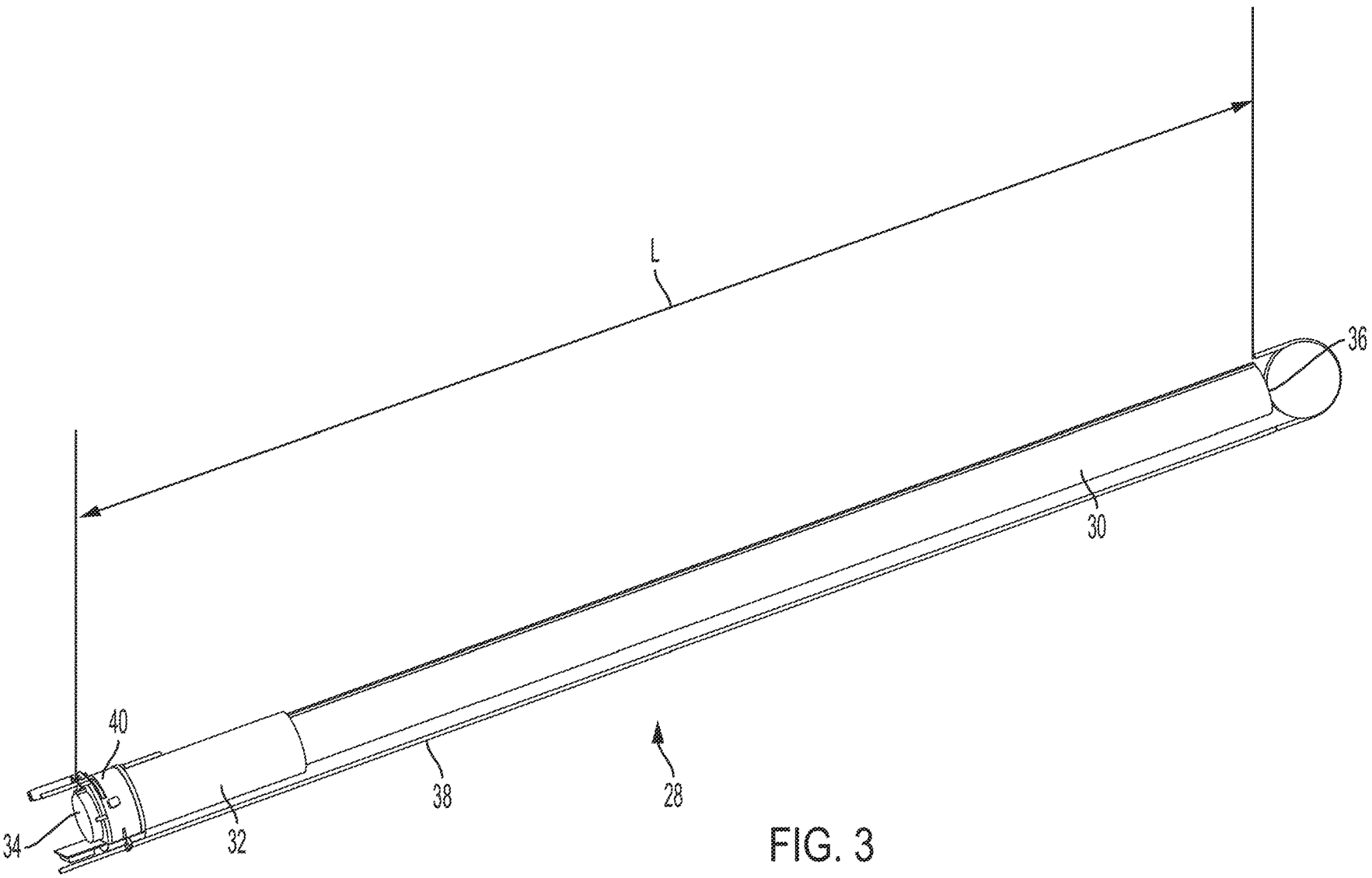
FIG. 3 is a perspective view of a boom actuator according to an embodiment.

FIG. 3 is a perspective view of a boom actuator 28 according to an embodiment. The boom actuator 28 is disposed within the telescoping boom 20 and is configured to move the telescoping sections 122, 124, 126, 128 to extend and retract a length of the telescoping boom 20. In one embodiment, the boom actuator 28 includes a fixed part 30 mounted in the base section 120 and a movable part 32 configured for movement along a length L of the fixed part 30. The movable part 32 may be fixed against rotation relative to the fixed part 30, for example, by a key and groove engagement.

The fixed part 30 may be an elongated member having a length L that in one embodiment is substantially the same as, or less than, a length of the base section 120. The movable part 32 is configured for translational movement along the fixed part 30. In one embodiment, the movable part 32 is movable between first and second ends 34, 36 of the fixed part 30 and is driven by a cabling system 38 (partially shown in FIG. 3). Thus, in one embodiment, the length L of the boom actuator is substantially fixed, regardless of the position of the movable part 32 on the elongated member. The cabling system 38 may be driven by a cable driving device (not shown), such as a rotatable drum or linear actuator. In another embodiment, the movable part 32 may be a cylinder (not shown) of a known hydraulic telescoping rod-cylinder assembly (not shown), the operation of which will be apparent to those having skill in the art. For example, in the telescoping rod-cylinder system, the cylinder may be extended relative to the rod to increase a length of the rod-cylinder system and retracted relative to the rod to decrease a length of the rod-cylinder system. Such a hydraulic telescoping rod-cylinder assembly is described in the above-mentioned U.S. Pat. App. Pub. No. 2017/0305727, incorporated herein by reference in its entirety.

Figure 4:
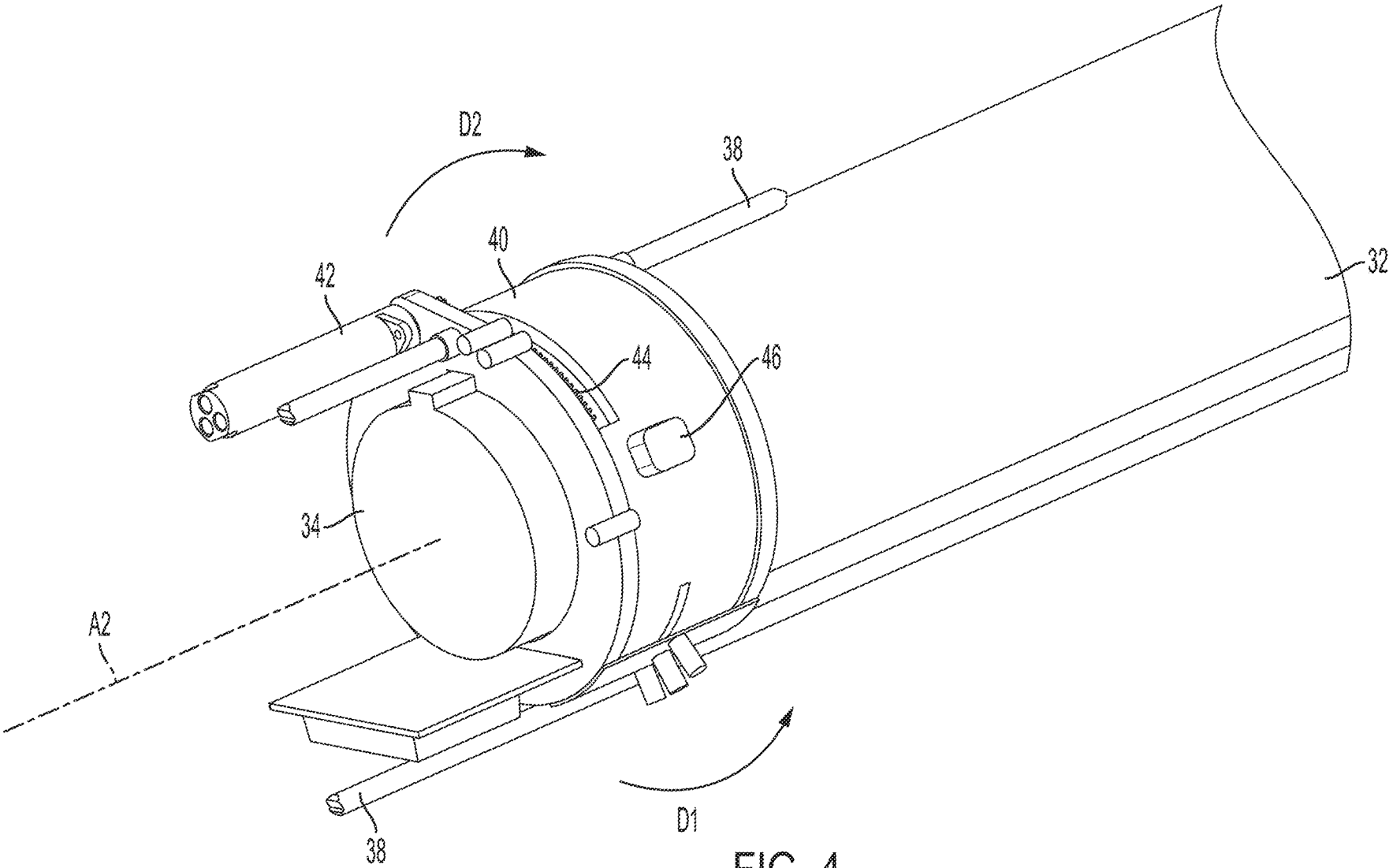
FIG. 4 is an enlarged view of a movable part of the boom actuator shown in FIG. 3.

FIG. 4 is an enlarged perspective view of the movable part 32, according to an embodiment. Referring to FIGS. 3 and 4, the boom actuator 28 further includes a rotary actuator 40 mounted on the movable part 32. The rotary actuator 40 is configured to rotate relative to the movable part 32 and may be axially fixed relative to the movable part 32. The rotary actuator 40 may be driven to rotate by a motor 42 such as, but limited to, an electric or air powered motor, and may be connected to the motor 42 by way of a gearing interface 44, such as a rack and pinion gear combination.

A coupling pin 46 extends from the rotary actuator 40. In one embodiment, the rotary actuator 40 and the coupling pin 46 may be formed integrally and continuously with one another. Further, in one embodiment, the coupling pin 46 may be fixed relative to the rotary actuator 40. In one embodiment, the longitudinal boom axis A1 is coaxial with an axis of rotation A2 of the rotary actuator 40 and the coupling pin 46. However, the present disclosure is not limited to such coaxial alignment.

Figure 5:
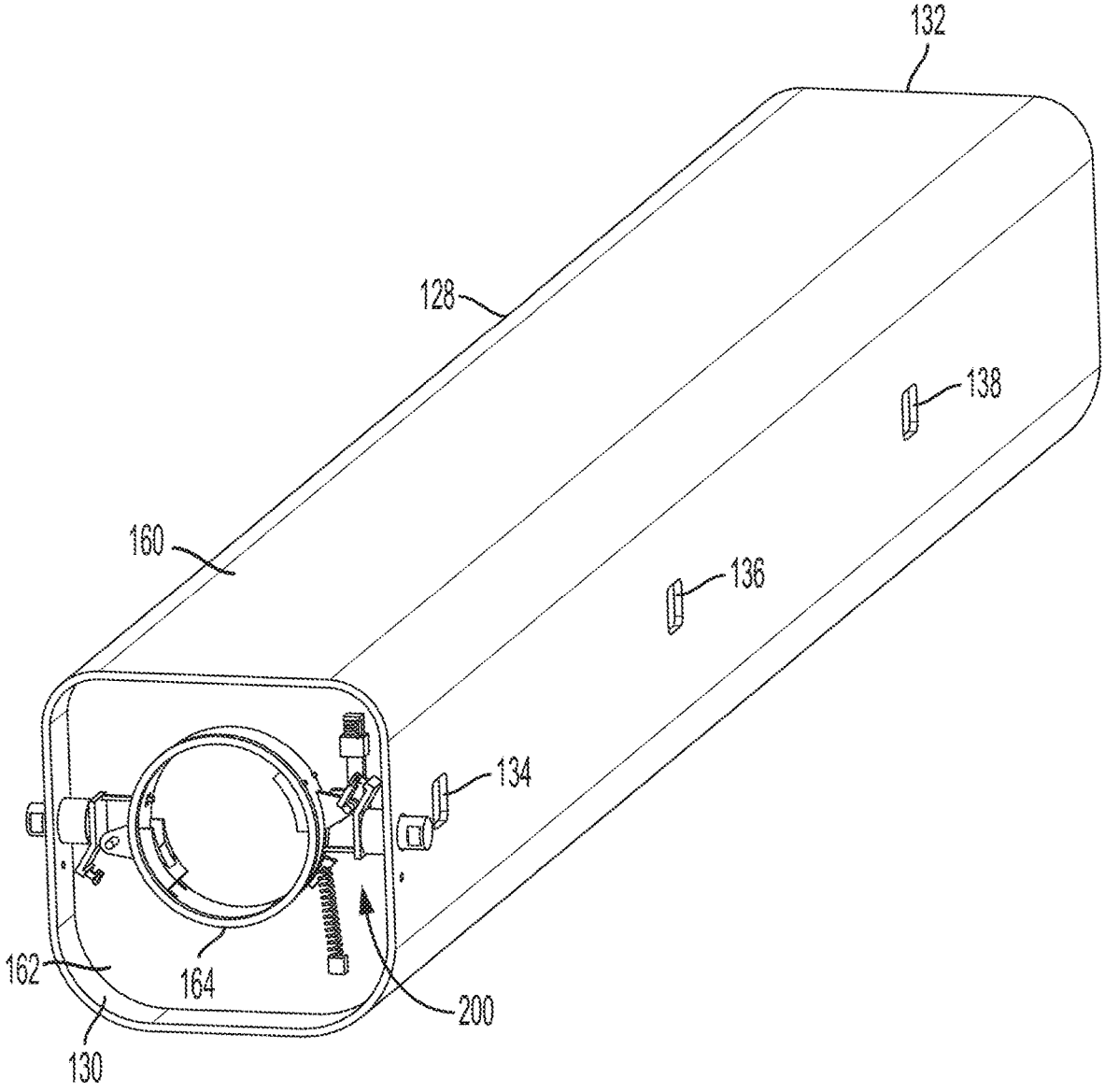
FIG. 5 is a perspective view of a telescoping section and a rotary extension and locking system according to an embodiment.

FIG. 5 is a perspective view of a telescoping section selected from the plurality of the telescoping sections 122, 124, 126, 128 according to an embodiment. For ease of reference, the telescoping section shown in FIG. 5 is identified with reference number 128, corresponding to the fourth telescoping section. However, it is understood that the telescoping section shown in FIG. 5 is representative of each telescoping section 122, 124, 126, 128, and that each of the telescoping sections 122, 124, 126, 128 may be formed having the same components as the other telescoping sections, unless described otherwise below.

Referring still to FIG. 5, the telescoping section 128 includes a plurality of lock openings, such as a first lock opening 134, a second lock opening 136 and a third lock opening 138. In one embodiment, the first lock opening 134 is positioned nearest a proximal end 130 of the telescoping section 128, the second lock opening 136 is positioned at an intermediate location, and the third lock opening 138 is positioned nearest a distal end 132 of the telescoping section 128. Additional or fewer intermediate lock openings may be provided. The base section 120, although not shown in FIG. 5, may include a plurality of similarly positioned lock openings. The lock openings 134, 136, 138 may be omitted from the first (innermost) telescoping section 122.

Figure 6:
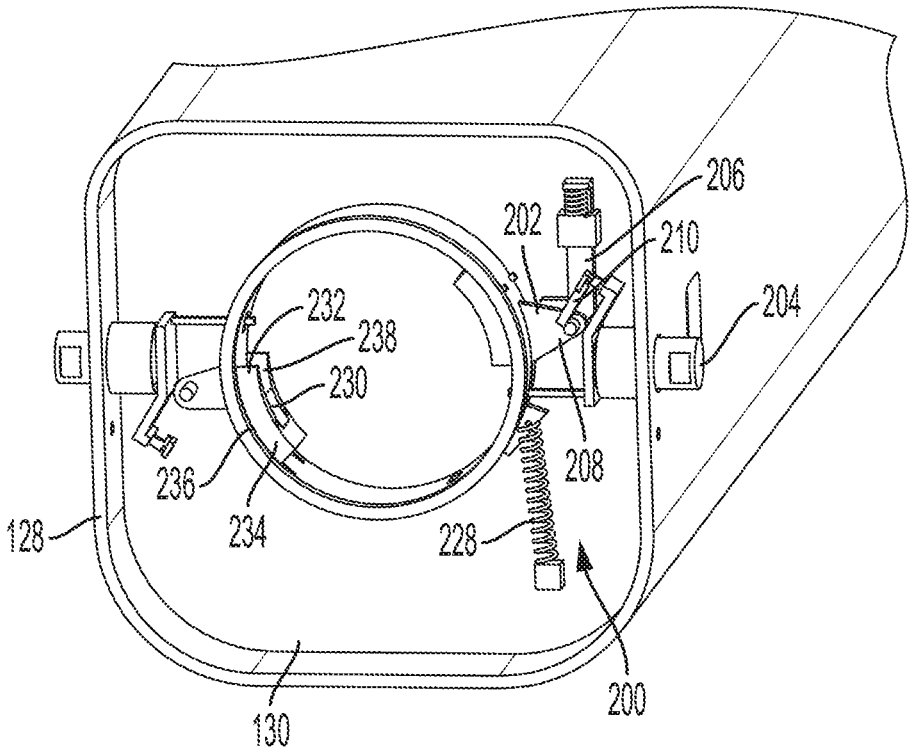
FIG. 6 is an enlarged view showing a coupling ring, a section pin and a latch of the rotary extension and locking system of FIG. 5.

FIG. 6 is an enlarged view of the proximal end 130 of the telescoping section of FIG. 5. With reference to FIGS. 5 and 6, the telescoping section 128 also includes a rotary extension and locking system 200 configured for selective coupling to the boom actuator 28 and selective locking with a nearest outwardly adjacent boom section (not shown in FIG. 5). According to one embodiment, the rotary extension and locking system 200 may be disposed at the proximal end 130 of the telescoping section 128 and includes a coupling ring 202, a section pin 204 and a latch 206. The coupling ring 202 is rotatably mounted on the telescoping section 128. The coupling ring 202 may be axially fixed relative to the telescoping section 128 as well. The coupling ring 202 is operably connected to the section pin 204, and the latch 206 is configured to selectively engage the section pin 204. In one embodiment, the coupling ring 202 is operably connected to the section pin 204 with an arm 208 that selectively engages a first surface 210 of the section pin 204. The rotary extension and locking system 200 may be included on each telescoping section 122, 124, 126, 128.

The rotary extension and locking system 200 is configured to be coupled to and uncoupled from the boom actuator 28 in a coupling operation and is further configured to lock and unlock a telescoping section from a nearest outwardly adjacent boom section in a locking operation. A telescoping section may be driven to extend or retract along the longitudinal boom axis A1 when the rotary and extension locking system 200 is coupled to the boom actuator 28 and unlocked from the nearest outwardly adjacent boom section. Conversely, a telescoping section is substantially fixed against telescoping movement along the longitudinal boom axis A1 when the rotary and extension locking system 200 is locked to the nearest outwardly adjacent boom section. Further, the boom actuator 28 may move relative to each boom section 120, 122, 124, 126, when the rotary extension and locking system 200 is uncoupled from the boom actuator 28.

In one embodiment, the coupling ring 202 is configured to receive the coupling pin 46 (FIG. 8) to couple the rotary extension and locking system 200 to the boom actuator 28

Figure 9:
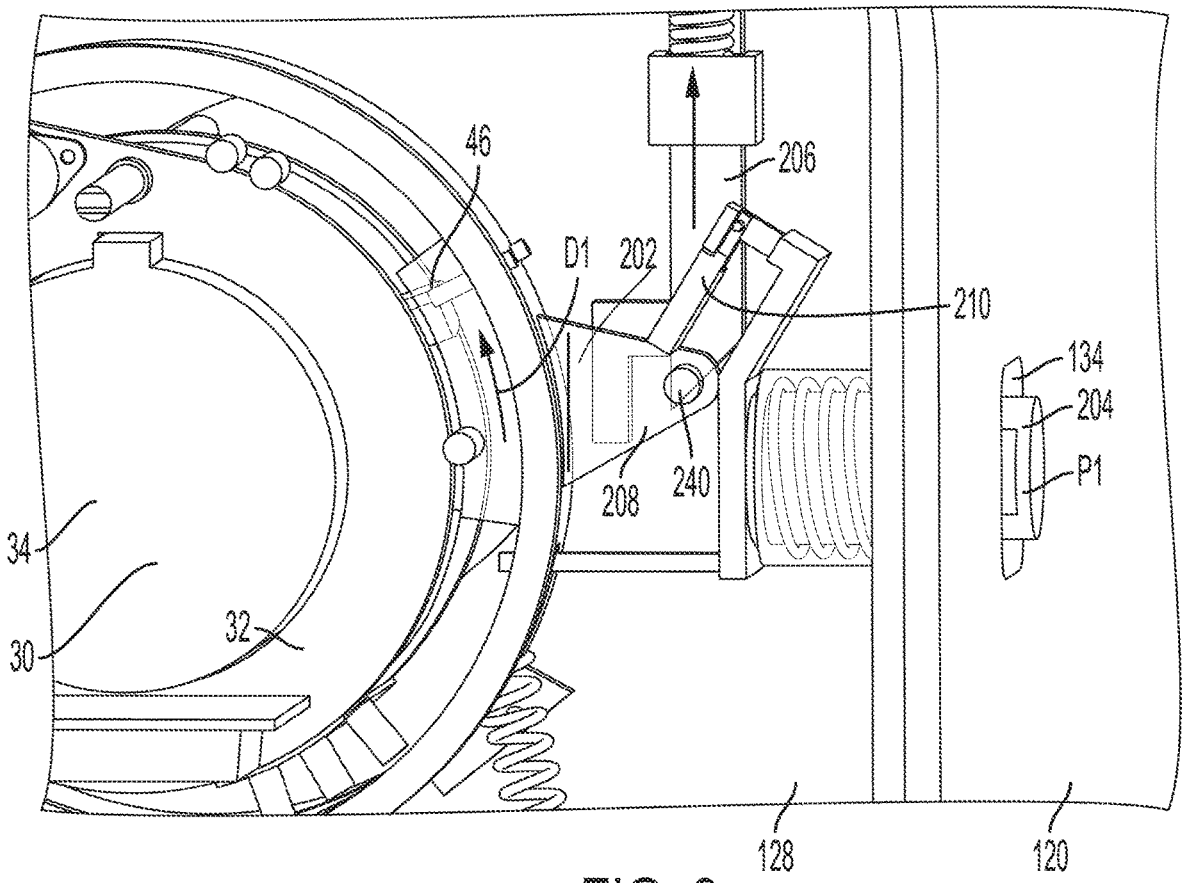
FIG. 9 shows a portion of the telescoping boom of FIG. 8 with the coupling ring rotated in a first direction from the initial rotational position, according to an embodiment.
Figure 12:
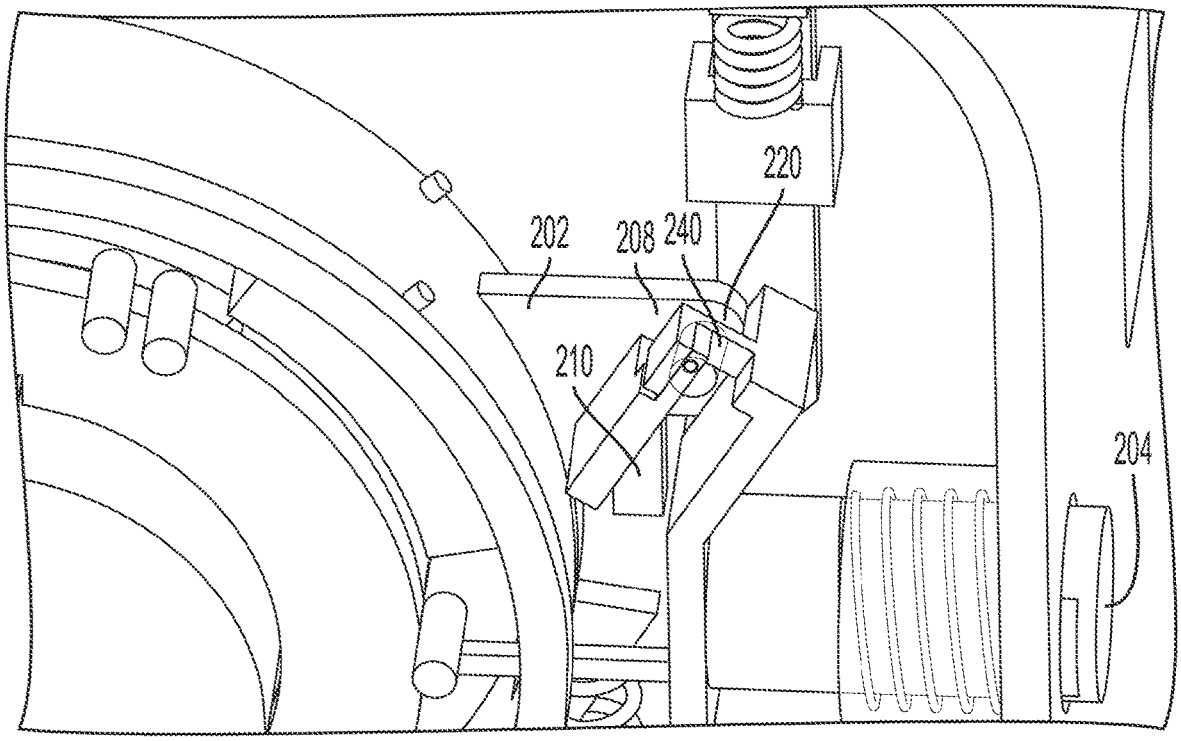
FIG. 12 is a perspective view showing the coupling ring and the section pin of FIG. 11 positioned relative to another.
Figure 13:
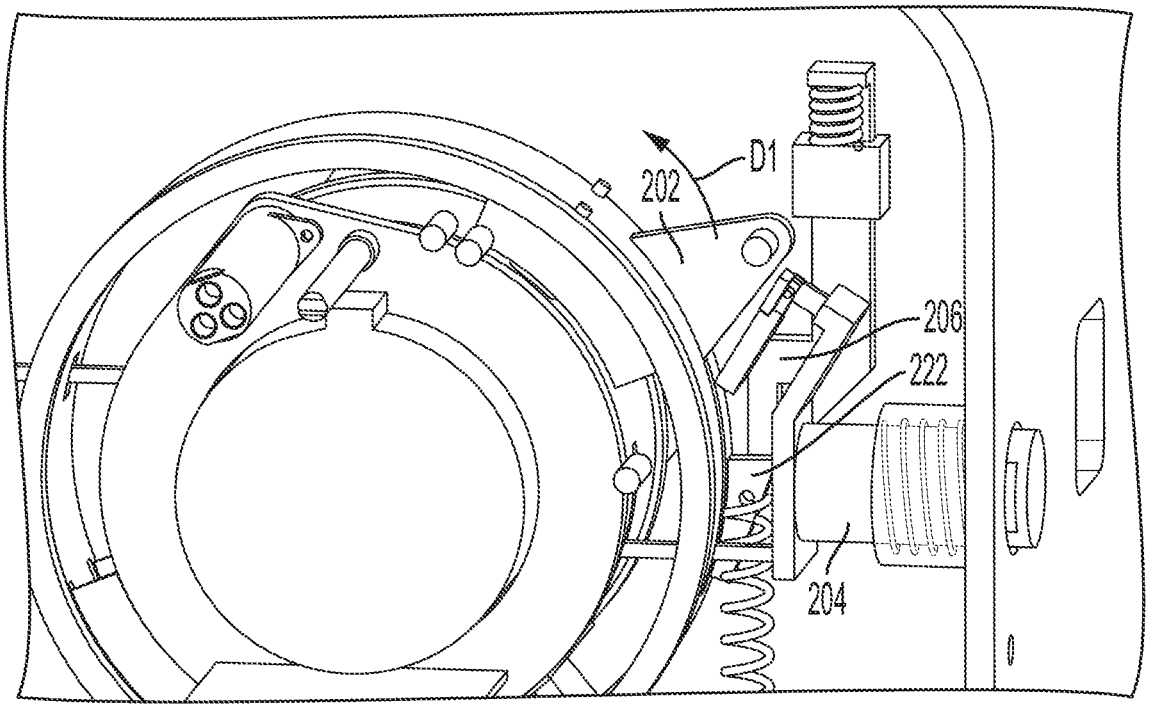
FIG. 13 shows the coupling ring, the section pin and the latch of FIG. 11 with the coupling ring rotated further in the first direction, according to an embodiment.

(FIG. 9). In addition, the coupling ring 202 is configured to rotate in the first direction D1 (FIG. 10) in response to rotation of the coupling pin 46 and rotary actuator 40 in the first direction D1. Rotation of the coupling ring 202 in the first direction D1 causes the section pin 204 to move from a first position P1 (FIG. 10) to a second position P2 (FIG. 11), thereby unlocking the rotary extension and locking system 200 from the nearest outwardly adjacent boom section. The latch 206 may be moved into interlocking engagement with the section pin 204 to hold the section pin 204 in the second position P2 (FIGS. 11-13).

Figure 14:
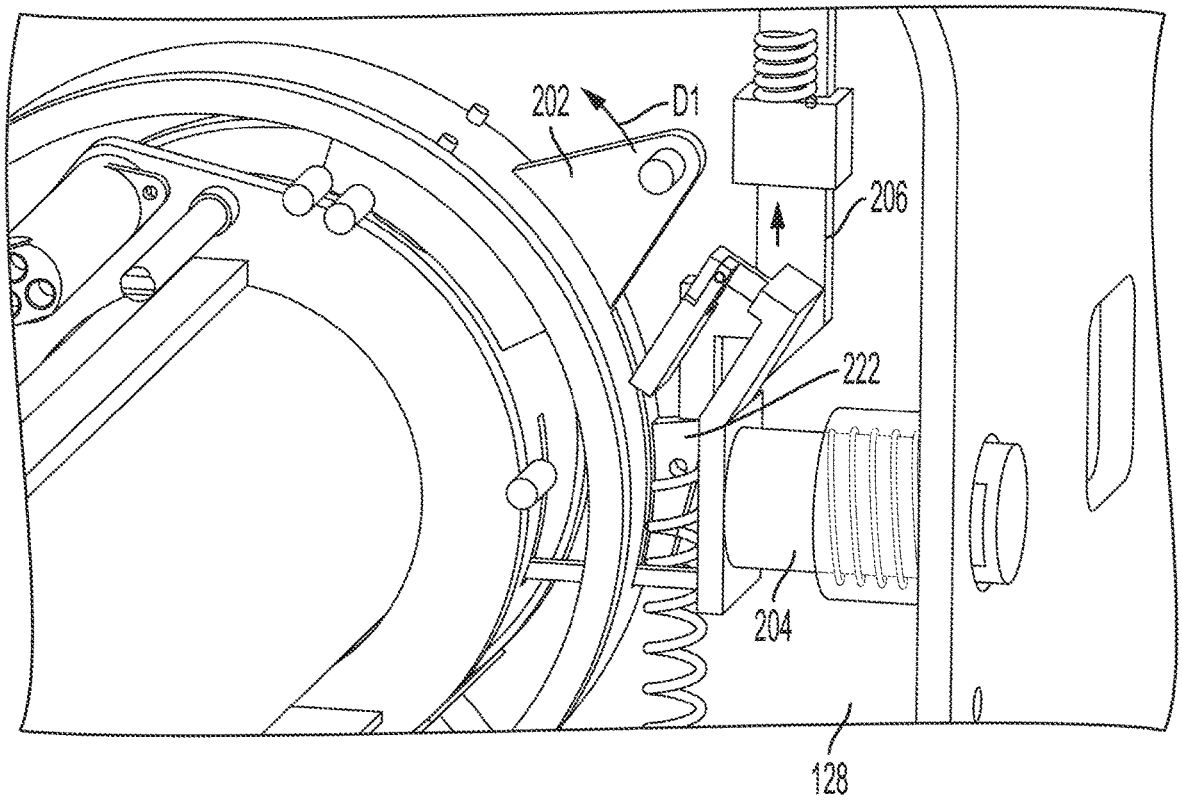
FIG. 14 shows the coupling ring, the section pin and the latch of FIG. 13 with the coupling ring rotated further in the first direction, according to an embodiment.

Further rotation of the coupling ring 202 in the first direction D1 may move the latch 206 out of engagement from the section pin 204 (FIG. 14). In one embodiment, the section pin 204 may then return to the first position P1 (FIG. 15), for example, under a spring force from a section pin spring 216. With the section pin 204 in the first position P1, the rotary extension and locking system 200 may be locked to the nearest outwardly adjacent telescoping section.

Figure 16:
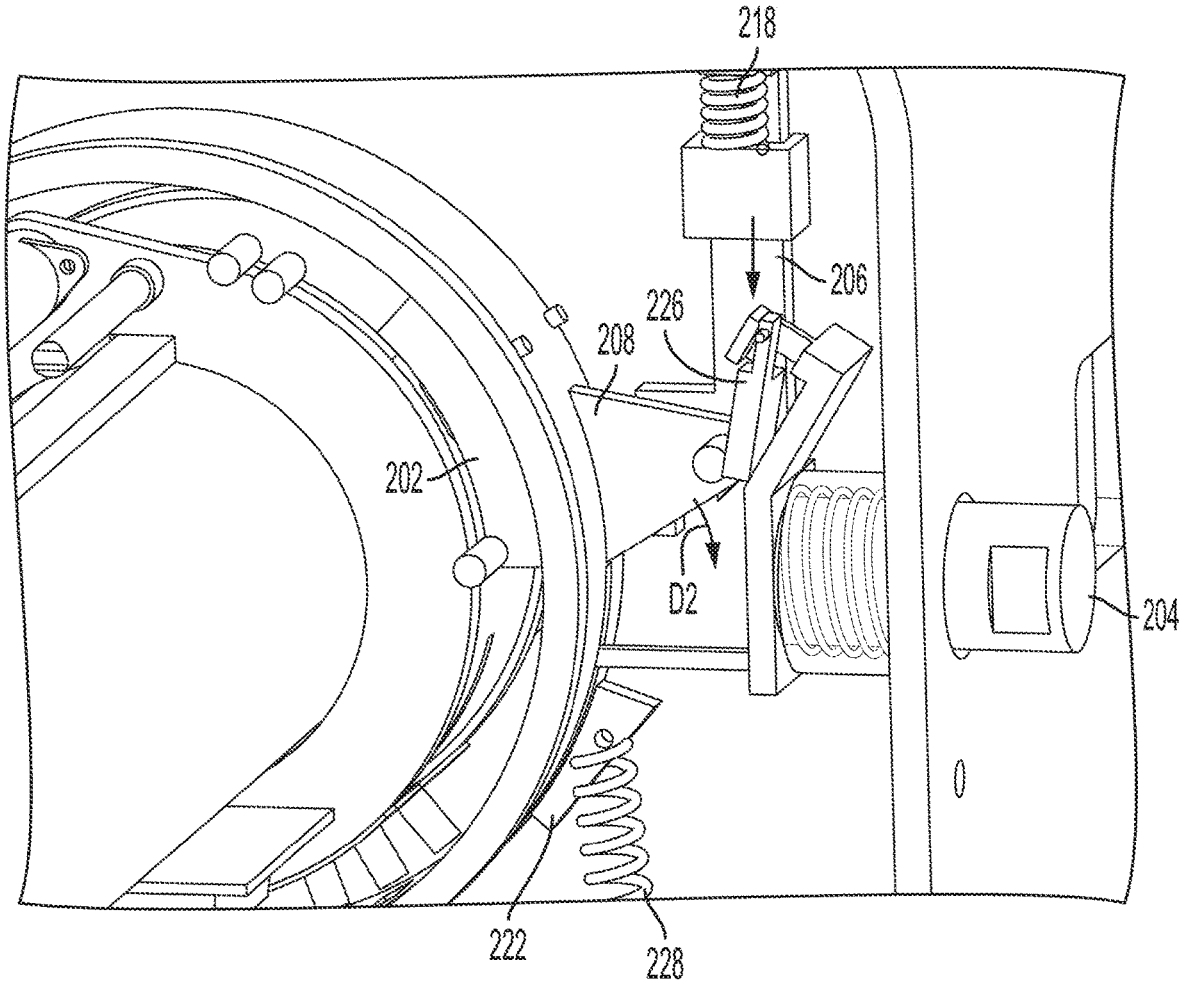
FIG. 16 shows the coupling ring, the section pin and the latch of FIG. 15 with the coupling ring rotated in a second direction, according to an embodiment.
Figure 17:
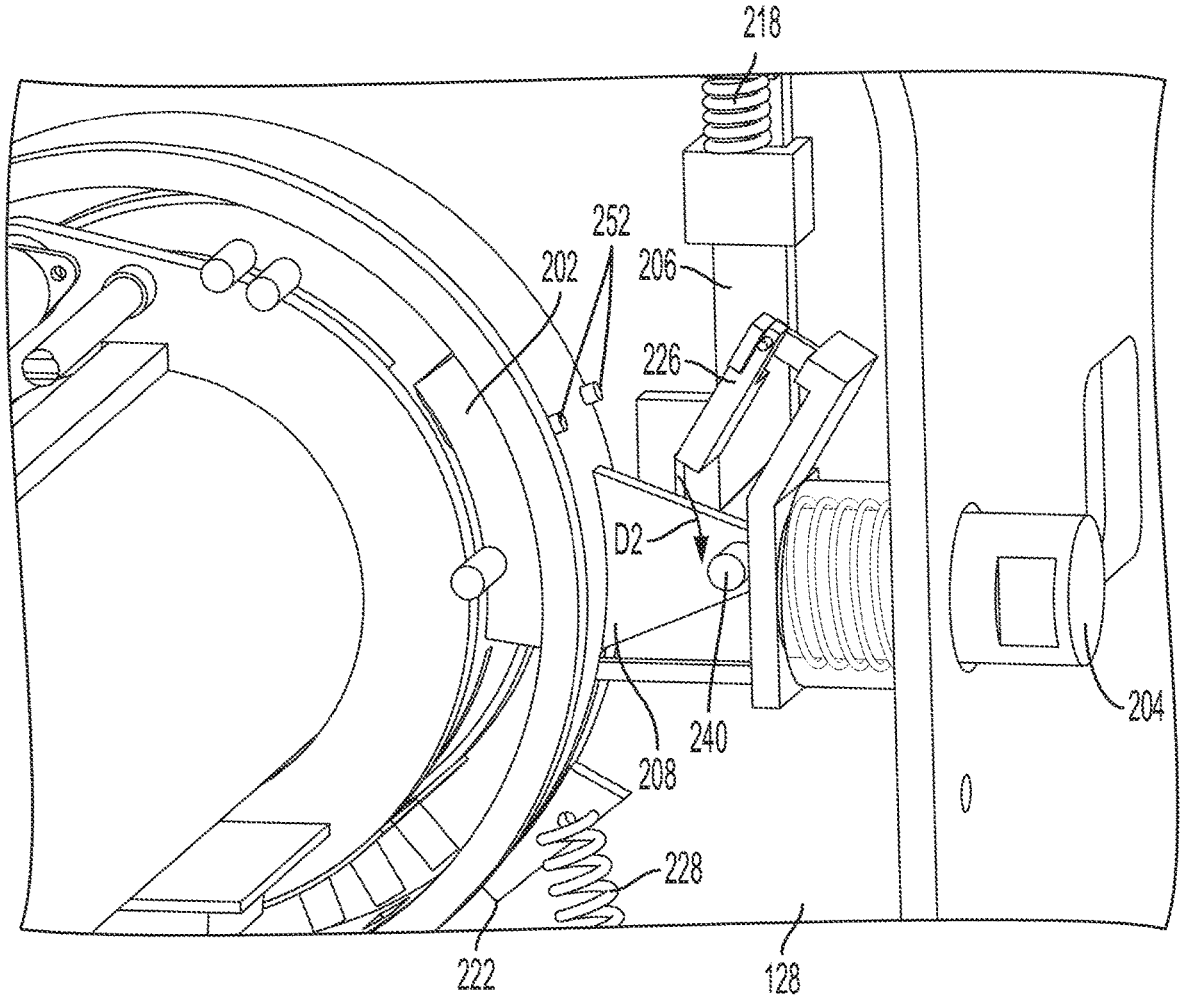
FIG. 17 shows the coupling ring, the section pin and the latch of FIG. 16 with the coupling ring rotated further in the second direction, according to an embodiment.

The coupling ring 202 also rotates in the second direction D2 (FIG. 16), for example, under a spring force of a coupling ring spring 228, to return to a START position (FIG. 17). The coupling pin 46 and rotary actuator 40 rotate in the second direction D2 with the coupling ring 202. The rotary extension and locking system 200 may be uncoupled from the boom actuator 28 in response to further rotation of the coupling pin 46 and rotary actuator 40 in the second direction D2 relative to the coupling ring 202 (FIG. 8).

Figure 7:
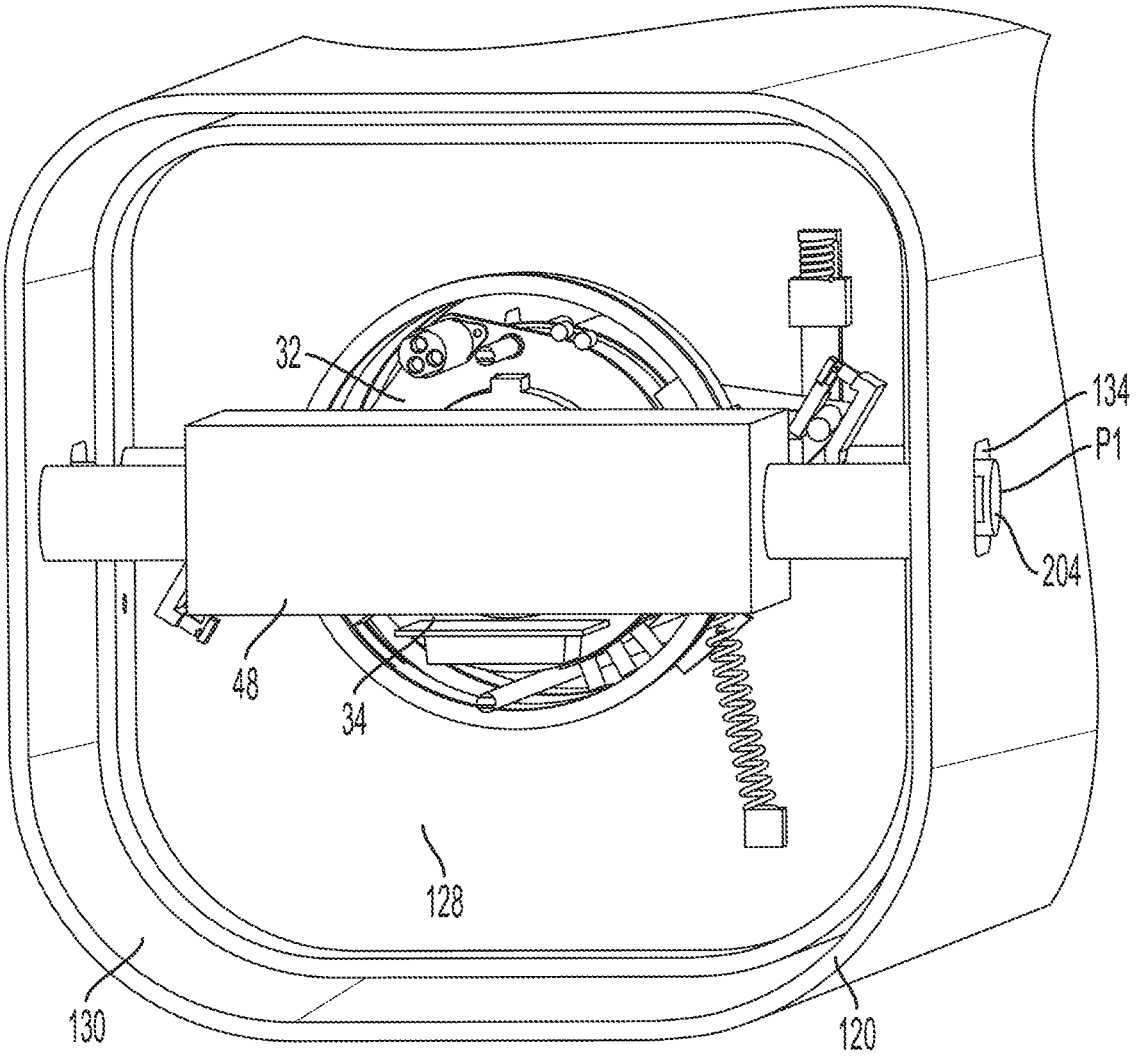
FIG. 7 is a perspective end view showing a portion of a telescoping section and a nearest outwardly adjacent boom section of a telescoping boom having the coupling ring, the section pin and the latch of FIG. 6, according to an embodiment.

FIGS. 7-18 show an example of operations of the rotary extension and locking system 200, together with the telescoping boom 20. FIG. 7 is an enlarged view of the proximal end 130 of the telescoping section 128 disposed within a nearest outwardly adjacent boom section, shown as the base section 120. The telescoping section 128 is shown in a retracted position relative to the base section 120. The section pin 204 is in a first position P1 and is engaged in a first lock opening 134 of the base section 120. In one embodiment, the fixed part 30 of the boom actuator 28 may be mounted to a mounting block 48.

Although not shown, in the configuration of FIG. 7 the third telescoping section 126 may already be extended relative to the fourth telescoping section 128 and the section pin 204 of the third telescoping section 126 may be in the first position P1 and engaged in the third lock opening 134 of the fourth telescoping section 128. The second telescoping section 124 and the first telescoping section 122 may be arranged similarly relative to the third telescoping section 126 and the second telescoping section 124, respectively.

Figure 8:
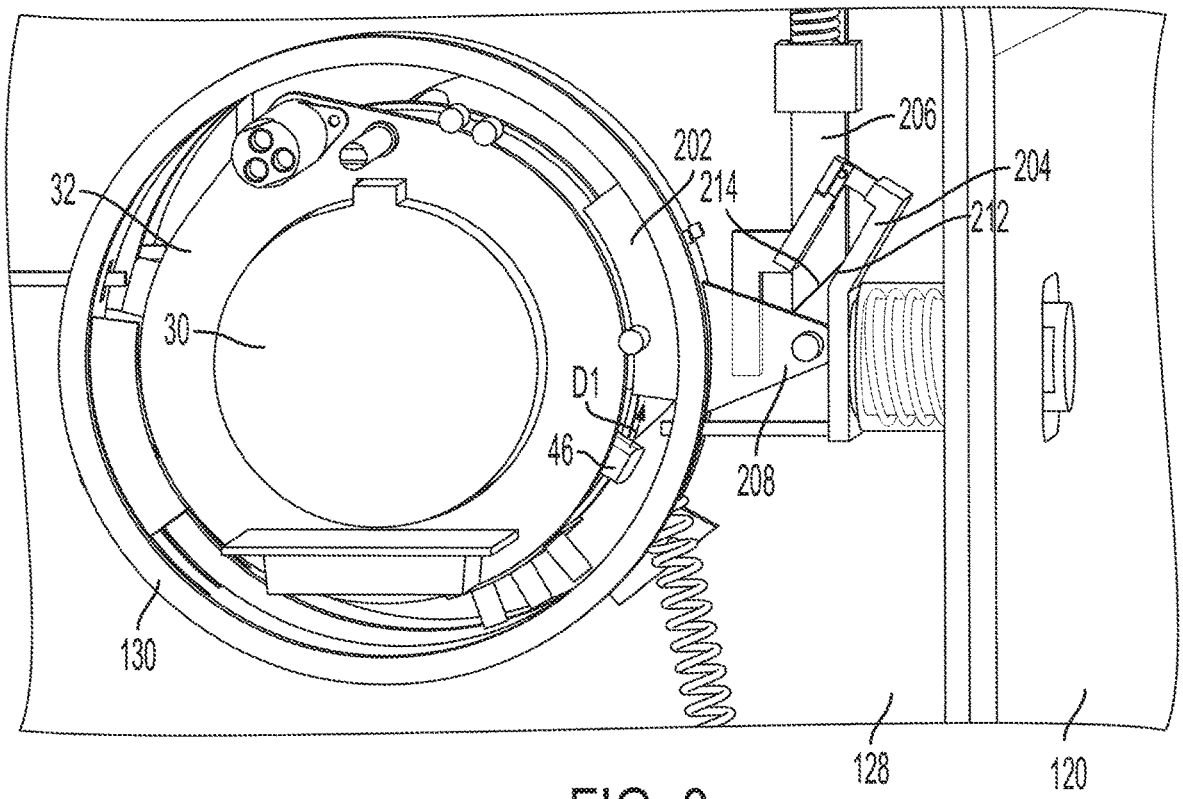
FIG. 8 shows the telescoping boom of FIG. 7 with the coupling ring at an initial rotational position and a coupling pin disengaged from the coupling ring, according to an embodiment.

Referring to FIG. 8, the coupling pin 46 is disengaged from the coupling ring 202. Thus, the boom actuator 28 is uncoupled from the rotary extension and locking system 200. Referring to FIG. 9, the rotary actuator 40 is rotated in a first direction D1 (indicated with arrow) to move the coupling pin 46 into engagement with the coupling ring 202, to couple the boom actuator 28 to the rotary extension and locking system 200 of the telescoping section 128.

Figure 10:
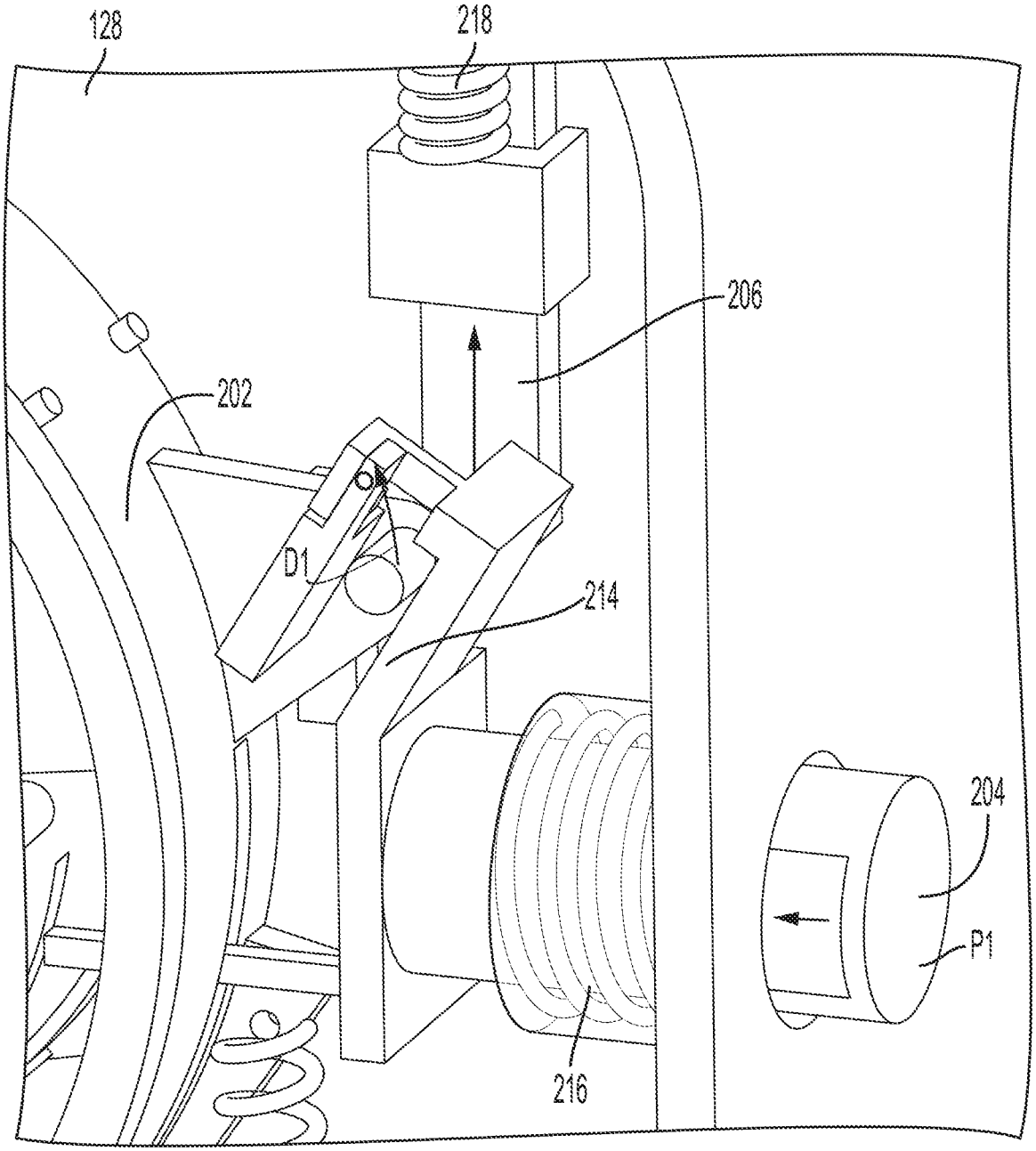
FIG. 10 is an enlarged view showing the coupling ring, the section pin and the latch of FIG. 9 with the coupling ring rotated in a first direction, according to an embodiment.
Figure 11:
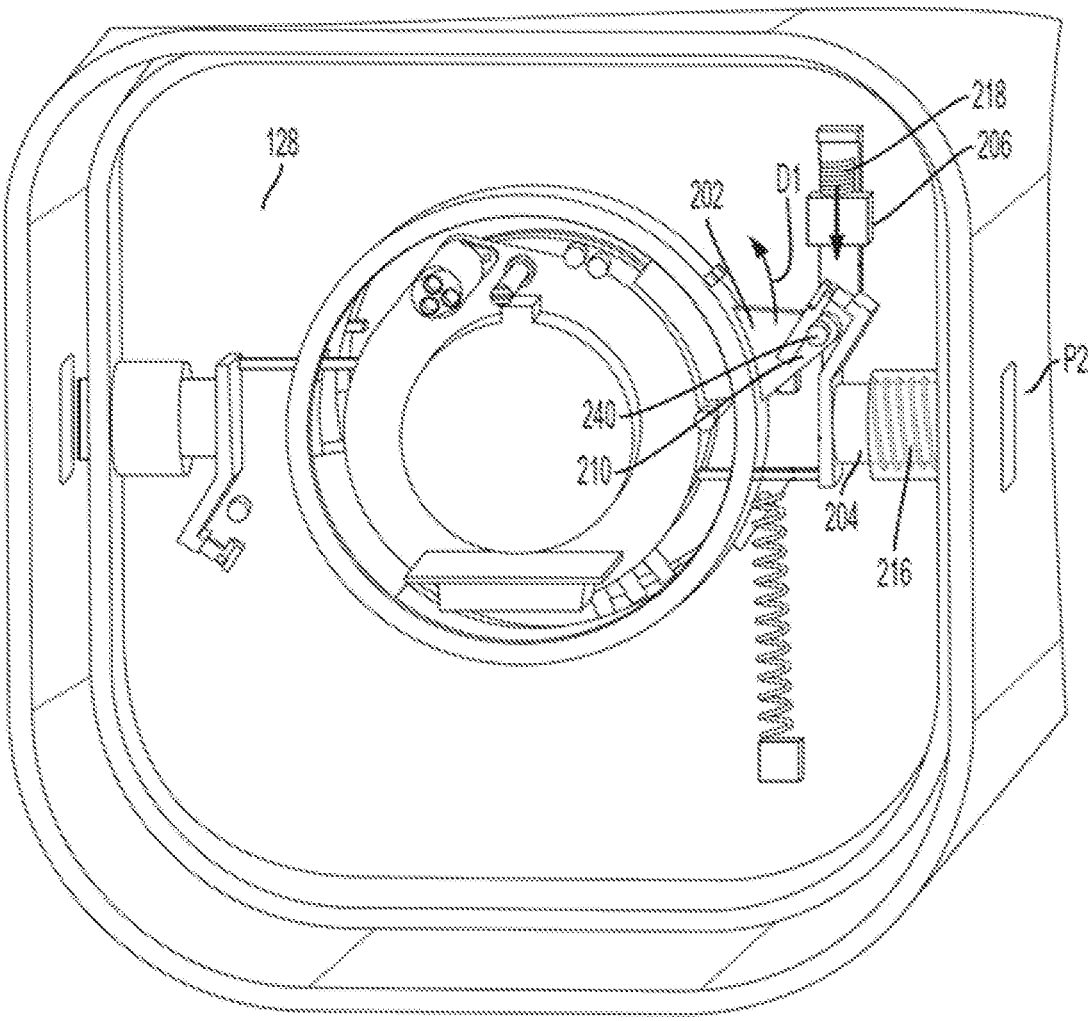
FIG. 11 shows the telescoping boom having the coupling ring, the section pin and the latch of FIG. 10 with the coupling ring rotated in the first direction, according to an embodiment.

Referring to FIGS. 10 and 11, continued rotation of the rotary actuator 40 in the first direction D1 causes the coupling pin 46 to rotate the coupling ring 202 in the first direction D1. Such continued rotation causes the section pin 204 to move from the first position P1 (the position shown in FIG. 9, for example) to a second position P2 (the position shown in FIGS. 10 and 11, for example). A direction of movement of the section pin 204 from the first position P1 to the second position P2 is indicated by an arrow on the section pin 204 in FIG. 10. In one embodiment, the first position P1 is an extended position where the section pin 204 is engaged in a lock opening of the nearest outwardly adjacent boom section 120 (FIG. 9) and the second position P2 is a retracted position where the section pin 204 is withdrawn from the lock opening 138 of the nearest outwardly adjacent boom section 120 (FIG. 11).

In one embodiment, a guide surface 212 (FIG. 8) of the section pin 204 contacts an angled surface 214 of the latch 206 when moving from the first position P1 to the second position P2 to move the latch 206 relative to the section pin 204 in the direction indicated by the arrow at the latch 206 in FIG. 9.

In one embodiment, the section pin spring 216 is operably coupled between the telescoping section 128 and the section pin 204 and urges the section pin 204 toward the first position P1. Additionally, a latch spring 218 may be operably coupled between the telescoping section 128 and the latch 206 to urge the latch 206 toward the section pin 204.

Referring to FIGS. 10-13, with the section pin 204 moved to the second position P2, the latch 206 is clear of the guide surface 212 and is urged into interlocking engagement with the section pin 204 (FIG. 13). Accordingly, the latch 206 may hold the section pin 204 in the second position P2.

Referring to FIGS. 12-14, continued rotation of the coupling ring 202 together with the coupling pin 46 and the rotary actuator 40 in the first direction D1 causes the coupling ring 202 to disconnect from section pin 204. For example, the arm 208 of the coupling ring 202 may move out of engagement with the first surface 210 of the section pin 204 through a groove 220 on the section pin 204. As shown in FIG. 13, continued rotation of the coupling ring 202, together with the coupling pin 46 and rotary actuator 40, in the first direction D1 causes a lug 222 on the coupling ring 202 to move into engagement with the latch 206.

With the coupling pin 46 engaged with the coupling ring 202, the boom actuator 28 is coupled to the telescoping section 128. In addition, with the section pin 204 in the second position P2, the telescoping section 128 is unlocked from the base section 120. Accordingly, movement of the movable part 32 along the fixed part 30 away from a proximal end 130 of the base section 120 causes movement of the telescoping section 128 to extend relative to the base section 120. Conversely, movement of the movable part 32 along the fixed part 30 toward the proximal end 130 of the base section 120 causes movement of the telescoping section 128 to retract relative to the base section 120. It is understood that the coupling pin 46 may alternatively engage with a coupling ring 202 of any other telescoping section 122, 124, 126 and operate in the manner described above.

Figure 15:
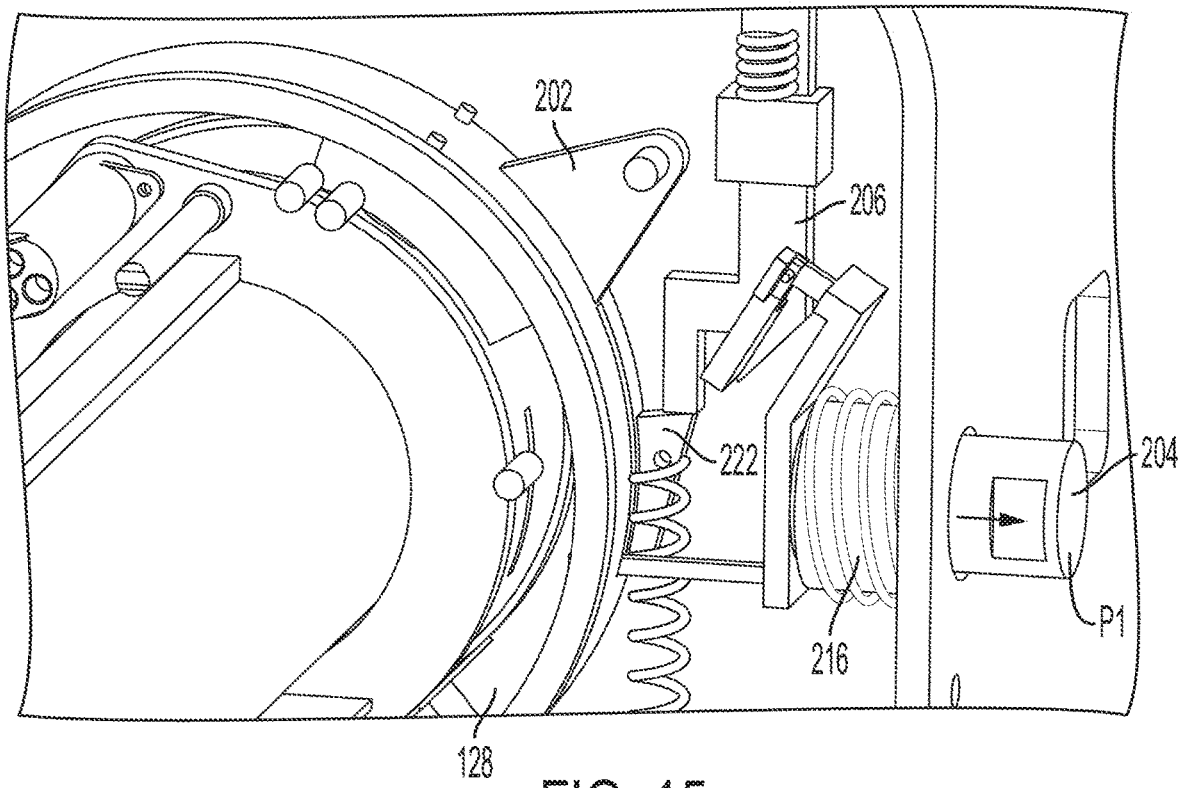
FIG. 15 shows the coupling ring, the section pin and the latch of FIG. 14 with the coupling ring rotated further in the first direction, according to an embodiment.

With reference to FIGS. 14 and 15, continued rotation of the coupling ring 202 in the first direction D1 causes the lug 222 to lift and disengage the latch 206 from the section pin 204. Accordingly, as shown in FIG. 15, the section pin 204 may move back to the first position P1, for example, under the force from the section pin spring 216.

In FIGS. 16 and 17, the coupling ring 202 is configured to rotate in a second direction D2 to move to a START position. As shown in FIG. 16, in one embodiment, the arm 208 may rotate into contact with and deflect a spring-loaded tab 226 on the section pin 204. Accordingly, sufficient clearance may be provided to allow the coupling ring 202 to continue rotating to the START position (FIG. 17). In FIG. 17, the spring-loaded tab 226 returns to a substantially undeflected condition in response to continued rotation of the coupling ring 202 in the second direction D2. The latch 206 may move toward the section pin 204 under a spring force from the latch spring 218.

In one embodiment, the coupling ring 202 rotates in the second direction D2 in response to rotation of the rotary actuator 40 and coupling pin 46 in the second direction D2. For example, the coupling ring 202 may follow or ride on the rotary actuator 40 and coupling pin 46 in the second direction D2 under the spring force from the coupling ring spring 228 operably coupled between the coupling ring 202 and the telescoping section 128.

Figure 18:
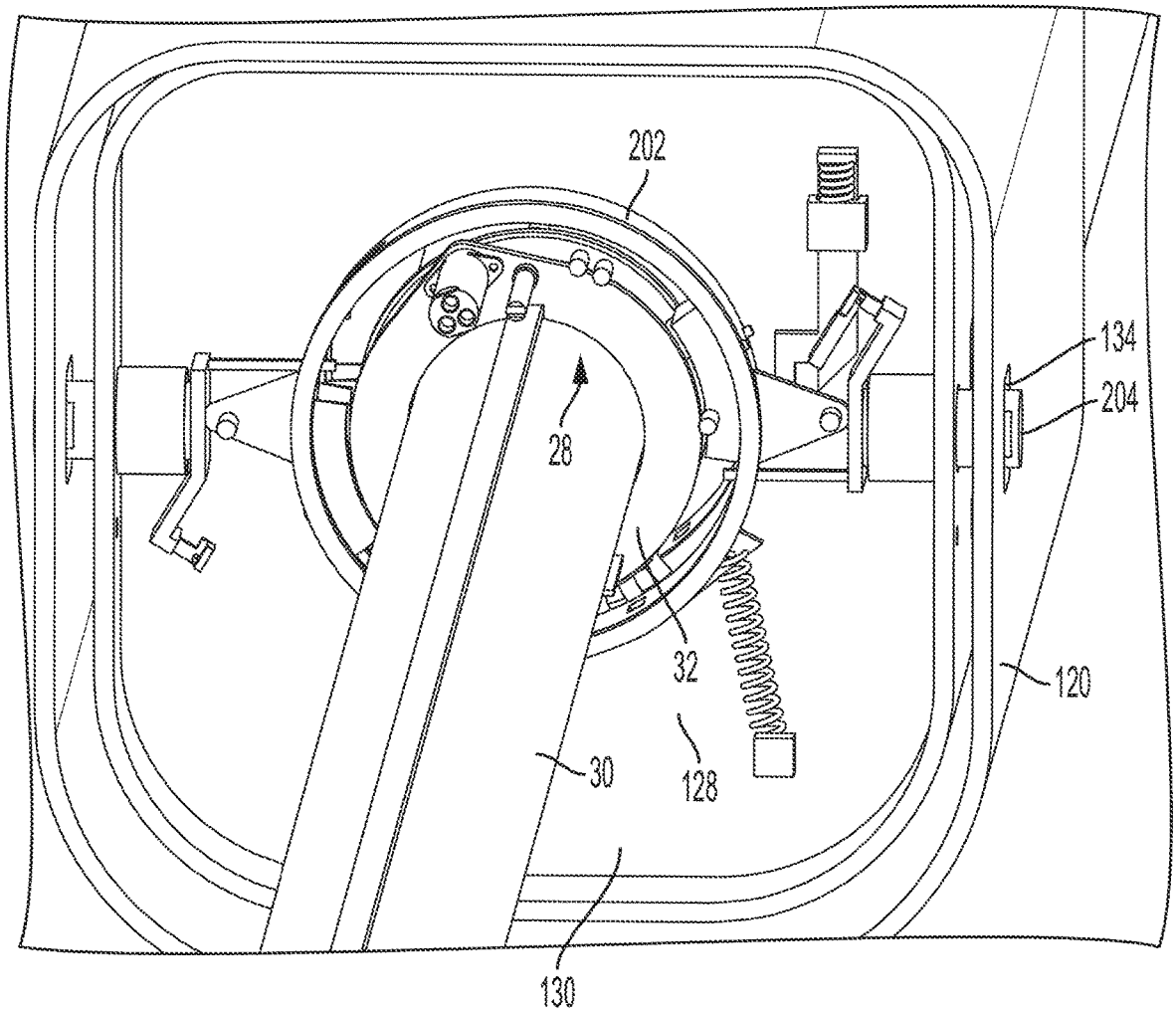
FIG. 18 is an enlarged perspective view showing a portion the telescoping boom with the section pin engaged in the adjacent telescoping section, according to an embodiment.
Figure 19:
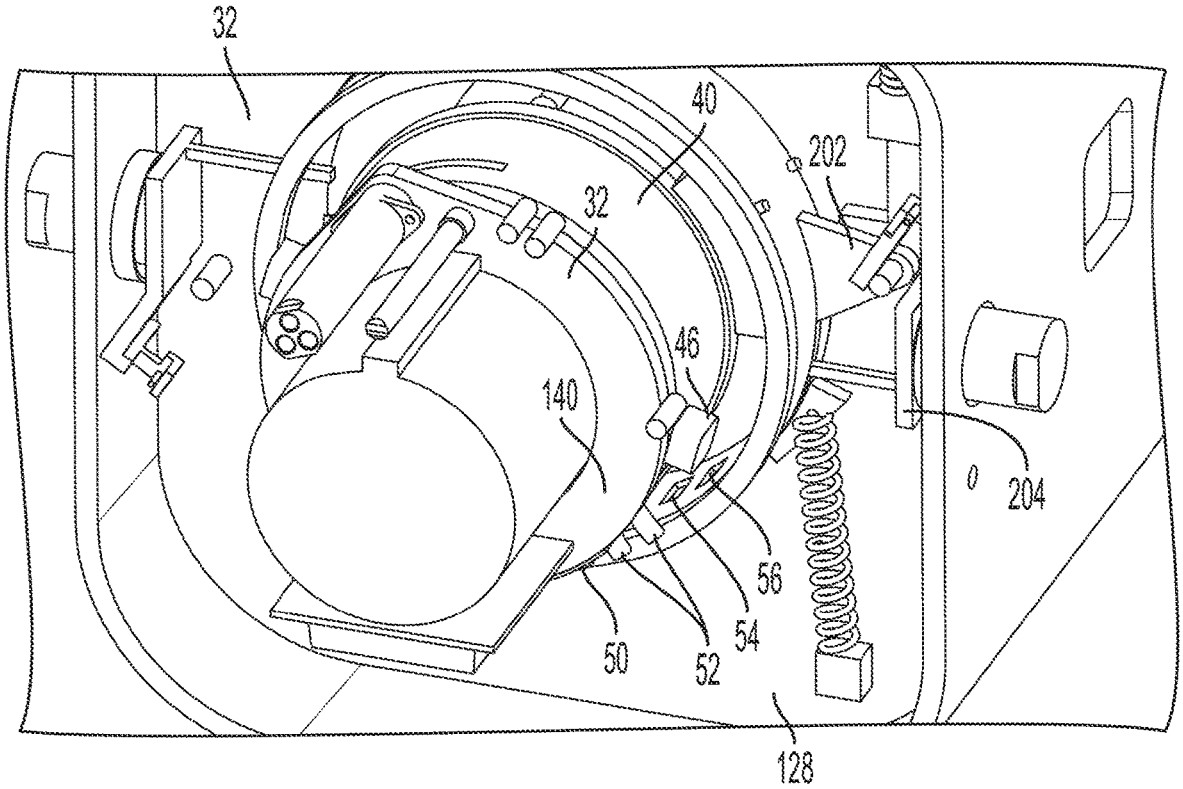
FIG. 19 is an enlarged view showing portions of a boom actuator and a rotary actuator positioned relative a telescoping section, according to an embodiment.

FIG. 18 is a perspective view showing the telescoping section 128 positioned extended from the base section 120. In the example of FIG. 18, the coupling ring 202 is in the START position. The section pin 204 of the telescoping section 128 is engaged in the third lock opening 134, of the base section 120.

The rotary actuator 40 and coupling pin 46 may be further rotated in the second direction D2 relative to the coupling ring 202 to disengage the coupling pin 46 from the coupling ring 202 (FIG. 8). Accordingly, the movable part 32 is then uncoupled from the telescoping section 128 and may move along the length of the fixed part 30 relative to the telescoping section 128. Thus, the movable part 32 may be moved to a next telescoping section to be moved and the operations above may be repeated.

The START position refers generally to a position of rotary extension and locking system 200 where the section pin 204 is in the first position P1 and the coupling ring 202 is positioned such that rotation in the first direction D1 will move the section pin 204 from the first position P1 toward to the second position P2.

Figure 21:
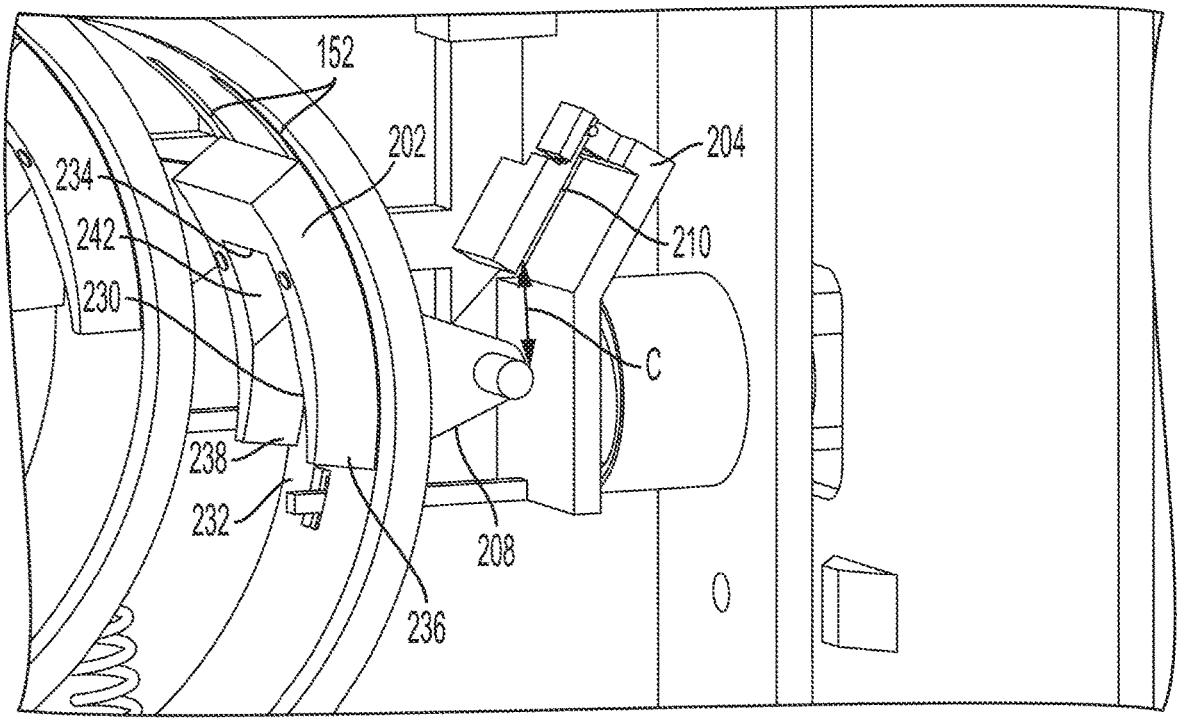
FIG. 21 is another perspective end view showing a portion of the telescoping boom of FIG. 7, according to embodiment.

In one embodiment, with reference to FIGS. 6, 8 and 21, the coupling pin 46 is rotated into engagement with a coupling slot 230 of the coupling ring 202. The coupling slot 230 includes an open end 232 to receive the coupling pin 46 and a closed end 234 against which the coupling pin 46 may apply a force causing the coupling ring 202 to rotate in the first direction D1. The coupling slot 230 is bound by axially spaced sidewalls 236, 238, which may be engaged by the coupling pin 46 to transmit an axially directed force from the movable part 32 to the telescoping section to be moved.

In one embodiment, the arm 208 of the coupling ring 202 includes a stud 240 (see FIG. 9, for example). The stud 240 may slide along the first surface 210 of a generally hooked-shaped section of the section pin 204 during rotation of the coupling ring 202 in the first direction D1 (see FIGS. 9 and 11, for example) to move the section pin 204 toward the second position P2. Further rotation of the coupling ring 202 in the first direction D1 causes the stud 240 to move through groove 220 of the section pin 204 to disengage the coupling ring 202 from the section pin 204 (see FIG. 13).

Although the figures illustrate only one section pin 204 operably connected to the coupling ring 202, it is understood that each telescoping section 122, 124, 126, 128 may include two section pins 204, each of which is operably coupled to the coupling ring 202 in a similar manner. Further, it is understood that two latches 206 may be included, each associated with a section pin 204, and configured in substantially the same manner as the latch 206 described above. That is, each telescoping section may include two rotary extension and locking systems 200.

Figure 20:
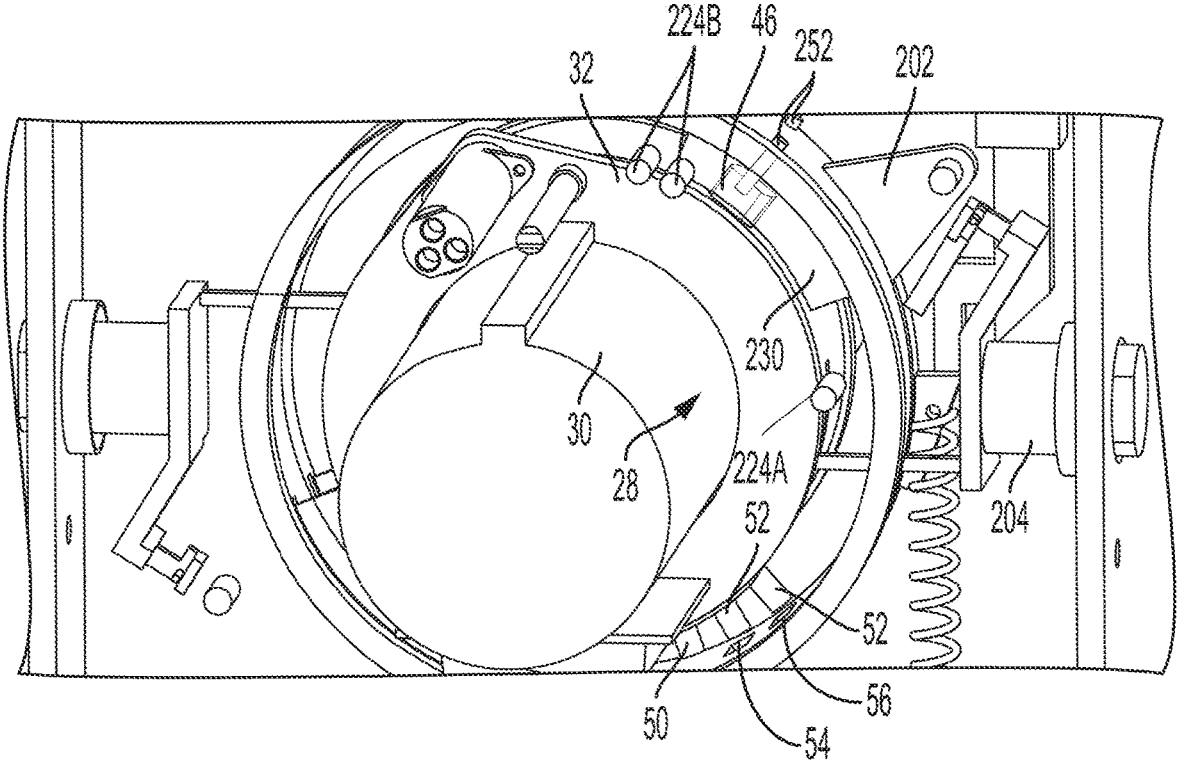
FIG. 20 is another view of the boom actuator and the rotary actuator of FIG. 19 positioned relative to the telescoping section with a coupling ring rotated in a first direction from an initial position, according to an embodiment.
Figure 22:
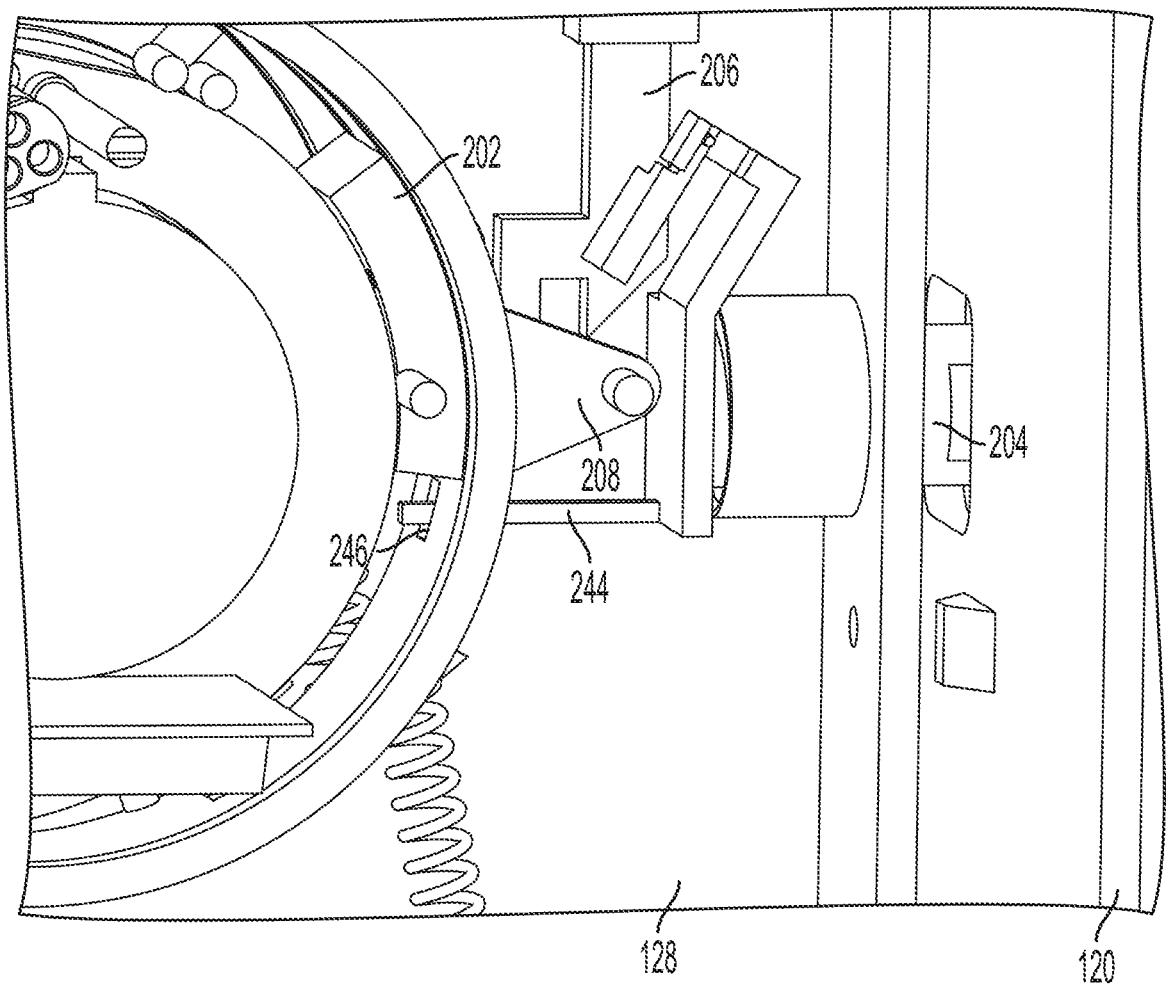
FIG. 22 is an end view of a telescoping boom having a section pin according to another embodiment.
Figure 23:
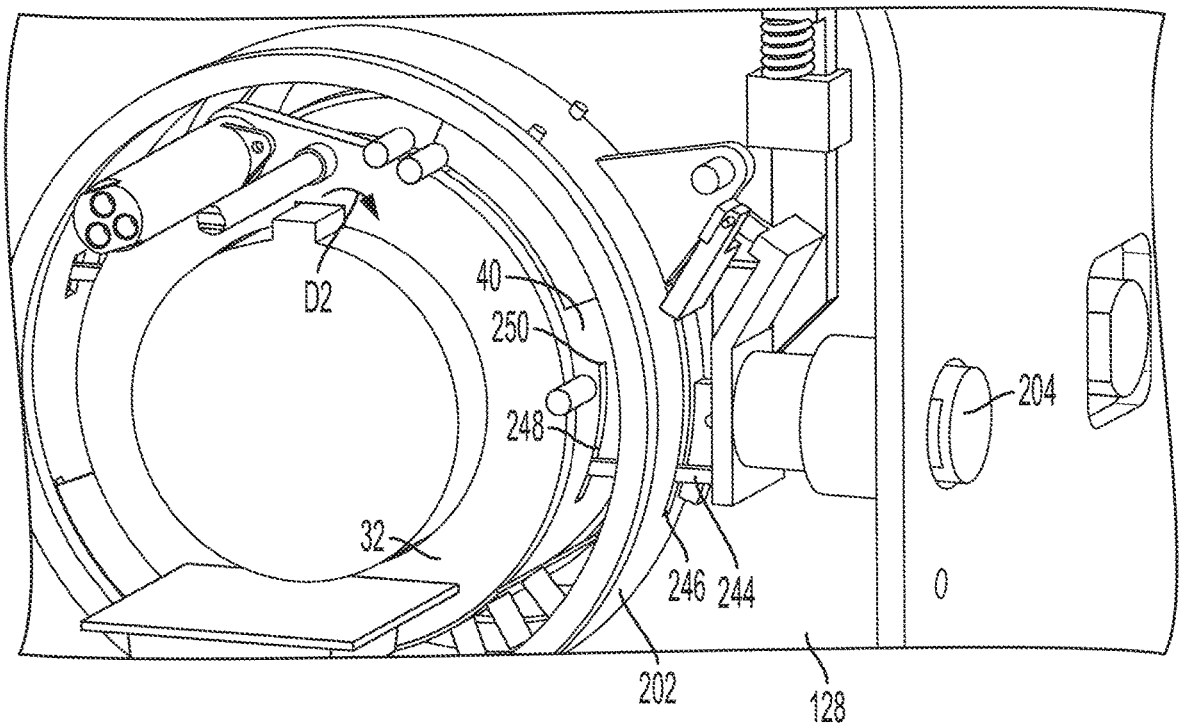
FIG. 23 is a perspective view of the telescoping boom of FIG. 22.

Referring to FIGS. 20, 22 and 23, in one embodiment, one or more first proximity switches 224A, 224B may be positioned along a travel path of the coupling pin 46 to detect a position of the coupling ring 202. For example, a first proximity switch or switches 224B may be positioned at a location where the coupling ring 202 is rotated in the first direction D1 a distance sufficient to move the section pin 204 to the second position P2. Another first proximity switch 224A may be positioned at a location where the coupling ring 202 is at a rotational position corresponding to the section pin 204 being in the first position P1.

In addition, one or more second proximity switches may be disposed on the movable part 32 or the rotary actuator 40. In one embodiment, the second proximity switches may include a foot section switch 50 configured to move to an ON state when moved into an engagement area 140 of a telescoping section 128. The second proximity switches may also include one or more pattern switches 52. The pattern switches 52 may be received in one or more pattern slots 54, 56 on the telescoping section 128 or coupling ring 202, and change state (e.g., ON or OFF) when received in a pattern slot 54, 56. In one embodiment, each telescoping section includes a different configuration of pattern slots 54, 56, such that all, some, or none of the pattern switches 52 will be received in a pattern slot 54, 56 depending on the particular telescoping section. Accordingly, a telescoping section may be identified based on states of the pattern switches 52.

With further reference to FIG. 20, the coupling pin 46 may be rotated into the coupling slot 230 of the coupling ring 202 on the telescoping section to be moved, and the coupling ring 202 rotated to a position where it may be detected by the first proximity switch 224B. In addition, the pattern switches 52 are shown being received in corresponding pattern slots 54, 56.

FIG. 21 is another perspective view of the coupling ring 202 positioned relative to the section pin 204, according to an embodiment. Movement of the coupling pin 46 against a flat section 242 formed on one or both of the sidewalls 236, 238 in coupling slot 230 may cause the telescoping section to lift slightly. Accordingly, a transverse load on the section pin 204 from the adjacent telescoping section may be reduced. In one embodiment, in the START position, there may be a clearance C between the arm 208 and the first surface 210 of the section pin 204 to provide a tolerance for a relatively small amount of rotation of the coupling ring 202.

Alternatively, or in addition to the first proximity switches 224, a rotation angle sensor (not shown) may measure the rotation of the rotary actuator 40 to determine a position of the coupling pin 46. In another embodiment, a proximity switch for the rotary actuator 40 may detect the rotation, and in turn, the position of the coupling pin 46, as opposed to the first proximity switches 224 the position of the coupling pin 46 relative to the coupling ring 202.

In the embodiments above, the coupling pin 46 is engaged in the coupling ring 202 before a section pin 204 is moved to the second position P2. In one embodiment, the coupling pin 46 may be held in the coupling ring 202, for example, by the weight of the telescoping sections supported at the connection of the coupling pin 46 and the coupling ring 202, by software control preventing rotation of the coupling pin 46 in the second direction D2, and/or by a mechanical interlock.

Figure 24:
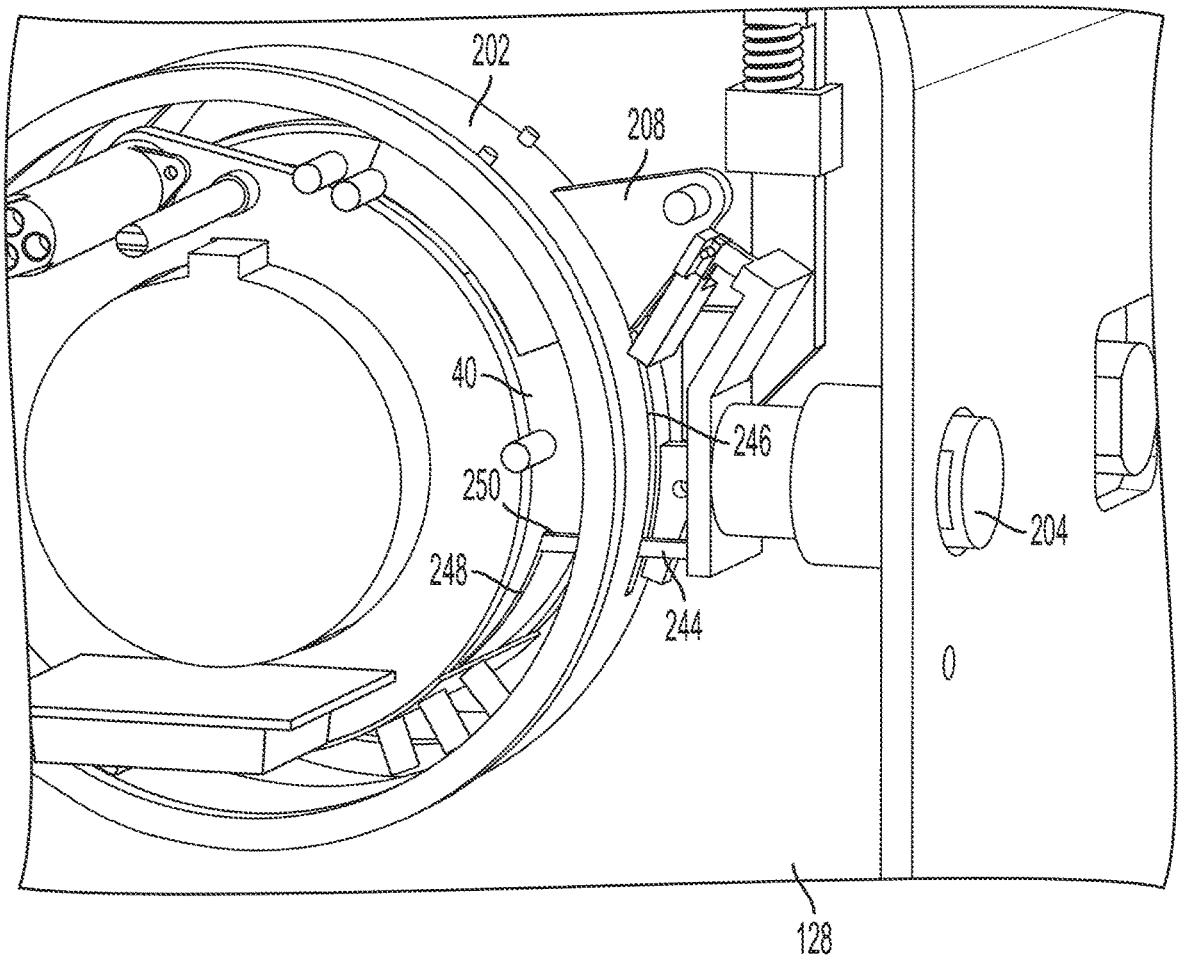
FIG. 24 is another perspective view of the telescoping boom of FIG. 22.

FIGS. 22-24 show an example of a coupling ring 202 and a section pin 204 which further includes an interlock pin 244. Referring to FIG. 22, in one embodiment, the interlock pin 244 extends through a first interlock slot 246 in the coupling ring 202 and/or the telescoping section 128 and is spaced from the rotary actuator 40. Referring to FIGS. 23 and 24, movement of the section pin 204 from the first position P1 toward the second position P2 moves the interlock pin 244 into a second interlock slot 248 formed in the rotary actuator 40. As shown in FIG. 24, in the event the rotary actuator 40 is rotated in the second direction D2, the interlock pin 244 engages a stop end 250 of the second interlock slot 248 to limit further rotation such that the coupling pin 46 remains engaged with the coupling ring 202.

Figure 25:
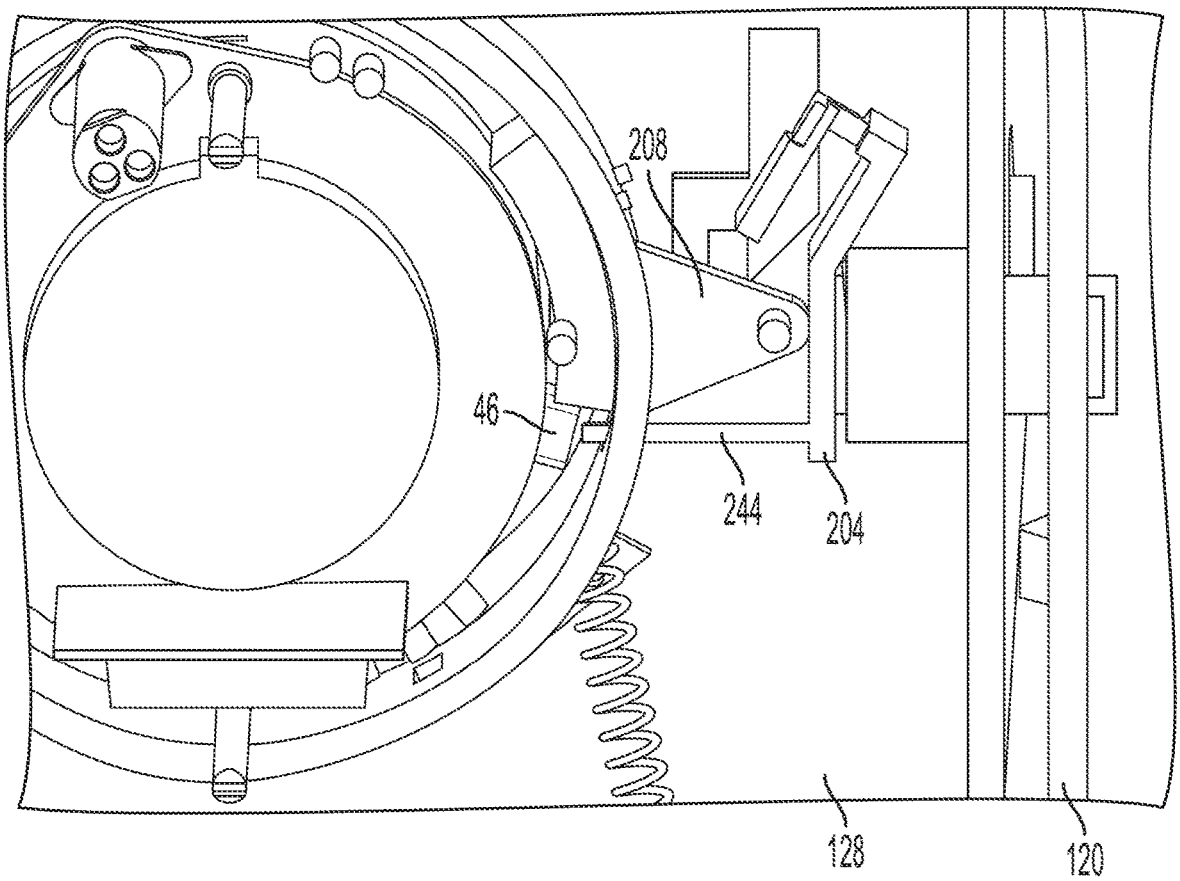
FIG. 25 is another end view of the telescoping boom of FIG. 22 with a coupling pin disengaged from a coupling ring according to an embodiment.

Referring to FIG. 25, the interlock pin 244 may also engage the coupling pin 46 to prevent movement of the section pin 204 to the second position P2 if the coupling pin 46 is not engaged with the coupling ring 202. The arm 208 of the coupling ring 202 may prevent movement of the section pin 204 toward the second position P2 as well.

Figure 26:
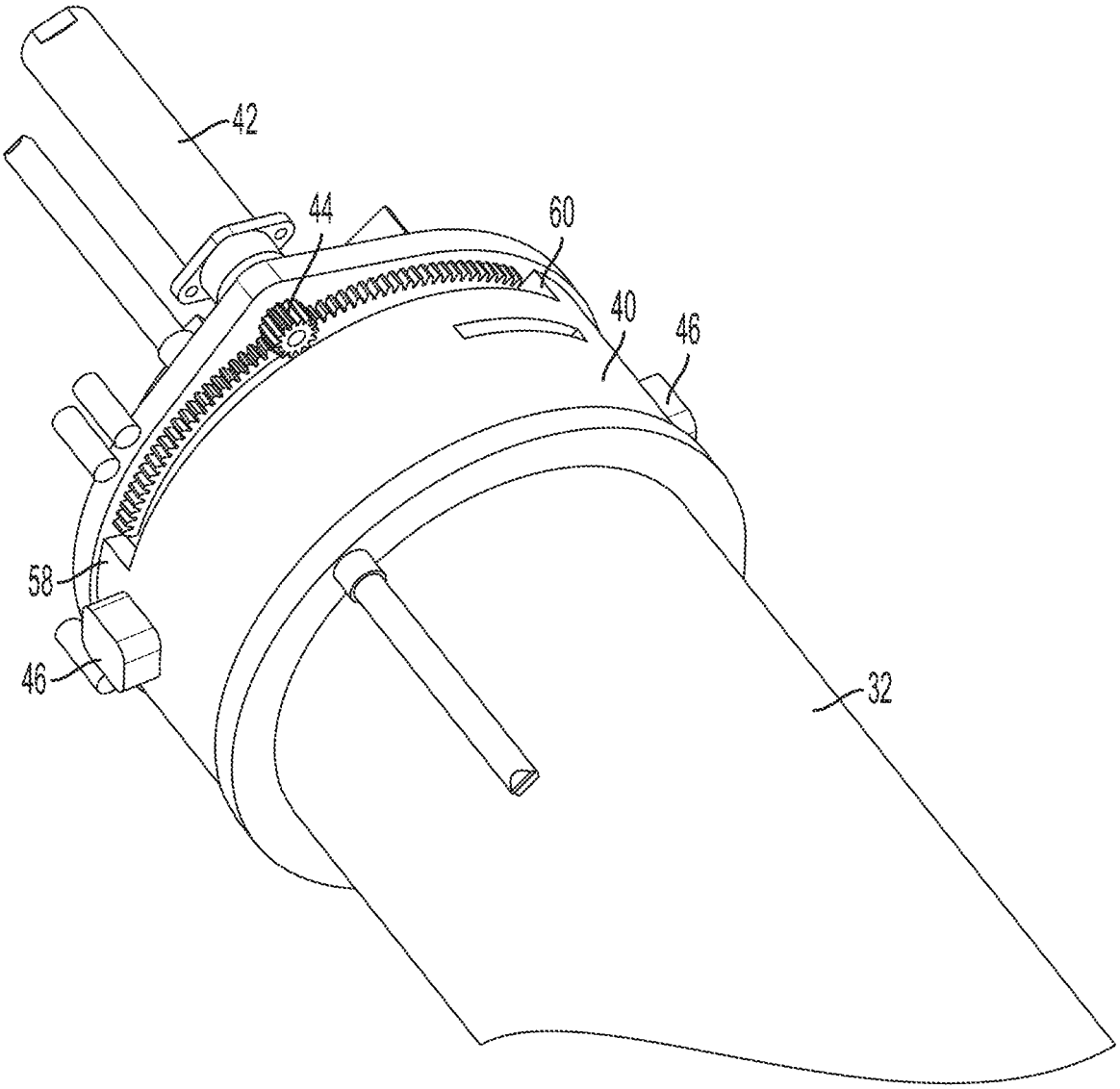
FIG. 26 is another perspective view of the movable part and rotary actuator of FIG. 4.

FIG. 26 is another perspective view of the movable part 32 and the rotary actuator 40 on the movable part 32, according to an embodiment. The motor 42 which drives the rotary actuator 40 may be rotationally limited by way of the gearing interface 44 with the rotary actuator 40.

Referring to FIGS. 17, 20 and 21, the coupling ring 202 may further include connecting pins 252 extending between and connecting a portion of the coupling ring 202 in which the coupling slot 230 is formed and a portion of the coupling ring 202 on which the arm 208 is formed. The connecting pins may rotationally fix such portions to one another. In addition, the connecting pins 252 extend through slots 152 on the telescoping section 128, for example, on a collar 164 of the telescoping section 128. Respective ends of the slots 152 serve to limit rotation of coupling ring 202 in a particular direction by preventing further rotation of the connecting pins 252. Accordingly, the coupling ring 202 is rotatable relative to the telescoping section 128.

In the embodiments above, the first 224A, 224B and second proximity switches 50, 52 may be operably connected to a control system 300 (shown schematically in FIG. 1). The control system 300 includes, for example, a memory configured to store program instructions, a microprocessor configured to execute the program instructions and an input/output (I/O) module through data may be transmitted to or from the control system 300. In one embodiment, the control system 300 receives the states of the first 224A, 224B and second proximity sensors 50, 52 and makes determinations based on the received switch states and stored rules regarding the switch states. In one embodiment, the control system 300 may be operably coupled to one or more crane components and may control operation of the one or more crane component based on the determinations. The control system 300 may be positioned on the crane 10, for example, in the operator cab, distributed among several locations on crane, remotely from the crane 10, or some combination thereof.

Further, in the embodiments above, and with reference to FIGS. 5-8, for example, a telescoping section of the plurality of telescoping sections may be formed as an elongated body 160 having an end face 162 at the proximal end 130. The rotary extension and locking system 200 maybe mounted on the end face 162 of the telescoping section 128. In one embodiment, the coupling ring 202 maybe rotationally mounted on the end face 162, for example to the collar 164, and is configured to rotate relative to the collar 164. The section pin 204 is operably coupled to the coupling ring 202 and is configured for movement relative to the end face 162 between the first position P1 and the second position P2. For example, in one embodiment, the section pin 204 is configured for translating movement relative to the end face 162 substantially in a lateral direction of telescoping section 128. The latch 206 may also be mounted on the end face 162 and configured for movement relative to the end face 162 toward and away from the section pin 204.

Accordingly, a telescoping boom may include a single rotary actuator, i.e., the rotary actuator 40, to carry out operations to couple and uncouple the boom actuator and the telescoping section, and to lock and unlock a telescoping section relative to an adjacent telescoping section.

It is understood the various features from any of the embodiments above are usable together with the other embodiments described herein.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. In addition, it is understood that terminology referring to orientation of various components, such as "upper" or "lower" is used for the purposes of example only, and does not limit the subject matter of the present disclosure to a particular orientation.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A telescoping boom comprising:

a boom actuator having a fixed part and a movable part;

a rotary actuator operably connected to the movable part and rotatable relative thereto;

a coupling pin connected to and configured to rotate with the rotary actuator;

a plurality of boom sections including a base section and one or more telescoping sections configured for telescoping movement along a longitudinal boom axis relative to the base section; and a rotary extension and locking system mounted to at least one telescoping section of the one or more telescoping sections, the rotary extension and locking system configured for selective coupling to the boom actuator and selective locking with a nearest outwardly adjacent boom section, wherein the rotary extension and locking system comprises:

a coupling ring rotatably mounted on the at least one telescoping section;

a section pin operably connected to the coupling ring; and a latch configured to selectively engage the section pin.

2. The telescoping boom of claim 1, further comprising:

a coupling ring spring operably coupled between the at least one telescoping section and the coupling ring to urge the coupling ring to rotate in a predetermined direction;

a section pin spring operably connected between the at least one telescoping section and the section pin to urge the section pin to move toward a first position; and a latch spring operably coupled between the at least one telescoping section and the latch to urge the latch in a direction toward the section pin.

3. The telescoping boom of claim 1, wherein the coupling pin engages the coupling ring in response to rotation of the rotary actuator in a first direction.

4. The telescoping boom of claim 3, wherein the coupling ring is rotated in the first direction to move the section pin from a first position to a second position in response to further rotation of the rotary actuator and the coupling pin in the first direction.

5. The telescoping boom of claim 4, wherein the latch selectively engages the section pin to hold the section pin in the second position.

6. The telescoping boom of claim 5, wherein the latch is moved into engagement with the section pin under a spring force from a latch spring.

7. The telescoping boom of claim 5, wherein the coupling ring disengages from the section pin in response to further rotation of the coupling ring in the first direction.

8. The telescoping boom of claim 7, wherein the coupling ring further comprises a lug, and the lug moves the latch out of engagement with the section pin in response to further rotation of the coupling ring in the first direction.

9. The telescoping boom of claim 8, wherein the section pin moves from the second position to the first position under a spring force of a section pin spring.

10. The telescoping boom of claim 9, wherein the coupling ring rotates in a second direction to a START position.

11. The telescoping boom of claim 10, wherein the section pin comprises a spring loaded arm and the coupling ring deflects the spring loaded arm during rotation in the second direction.

12. The telescoping boom of claim 10, wherein the coupling ring rotates in the second direction under a spring force from a coupling ring spring.

13. The telescoping boom of claim 10, wherein the coupling pin disengages the coupling ring in response to rotation of the rotary actuator in the second direction relative to the coupling ring.

14. The telescoping boom of claim 1, wherein the coupling ring comprises a coupling slot in which the coupling pin engages the coupling ring.

15. The telescoping boom of claim 1, wherein the section pin further comprises an interlock pin configured to selectively engage the rotary actuator.

16. The telescoping boom of claim 1, wherein the rotary actuator carries out a coupling operation by rotating the coupling pin into engagement with the coupling ring and carries out a section unlocking operation by rotating the coupling ring to move the section pin to the second position.

17. A telescoping boom section comprising:

an elongated section body having an end face; and a rotary extension and locking system comprising:

a coupling ring rotatably mounted on the end face and configured to receive a coupling pin;

a section pin operably connected to the coupling ring; and a latch mounted on the end face and configured to selectively engage the section pin, wherein the coupling ring is configured to rotate relative to the end face in a first direction, wherein the section pin is configured to move relative to the end face from a first position to a second position in response to rotation of the coupling ring in the first direction, and wherein the latch is configured to engage the section pin to hold the section pin in the second position.

18. The rotary extension and locking system of claim 17, wherein the latch is moved out of engagement with the section pin in response to further rotation of the coupling ring in the first direction.

* * * * *